US009447606B2

(12) United States Patent
Winkler et al.

(10) Patent No.: US 9,447,606 B2
(45) Date of Patent: Sep. 20, 2016

(54) LOCKING SYSTEM

(75) Inventors: Helge Winkler, Boesdorf (DE); Joerg Havemann, Bad Bodenteich (DE); Rainer Morgenthal, Boesdorf (DE)

(73) Assignee: Volkswagen AG, Wolfsburg (DE)

( * ) Notice: Subject to any disclaimer, the term of this patent is extended or adjusted under 35 U.S.C. 154(b) by 0 days.

(21) Appl. No.: 13/482,688

(22) Filed: May 29, 2012

(65) Prior Publication Data

US 2012/0279265 A1 Nov. 8, 2012

Related U.S. Application Data

(63) Continuation of application No. PCT/EP2010/007173, filed on Nov. 26, 2010.

(30) Foreign Application Priority Data

Nov. 28, 2009 (DE) ..... 10 2009 056 236

(51) Int. Cl.

| | |
|---|---|
| ***E05B 29/04*** | (2006.01) |
| ***E05B 29/10*** | (2006.01) |
| ***E05B 19/08*** | (2006.01) |
| ***E05B 29/00*** | (2006.01) |
| ***E05B 63/00*** | (2006.01) |
| *E05B 19/00* | (2006.01) |

(52) U.S. Cl.

CPC ..... *E05B 29/00* (2013.01); *E05B 63/0056* (2013.01); *E05B 19/0052* (2013.01); *E05B 29/004* (2013.01); *E05B 29/0033* (2013.01); *Y10T 70/7565* (2015.04); *Y10T 70/7599* (2015.04); *Y10T 70/7881* (2015.04)

(58) Field of Classification Search

CPC ..... E05B 29/00; E05B 63/0056; E05B 19/0052; E05B 29/0033; E05B 29/004; E05B 29/0046; Y10T 70/7565; Y10T 70/7599; Y10T 70/7616; Y10T 70/7881

USPC ..... 70/409, 492, 358, 337–343, 377, 392, 70/421, 495

See application file for complete search history.

(56) References Cited

U.S. PATENT DOCUMENTS 2,039,126 A * 4/1936 Svoboda ..... 70/358
4,977,767 A * 12/1990 Prunbauer ..... 70/406

(Continued)

FOREIGN PATENT DOCUMENTS

DE 199 44 070 A1 4/2001
DE 299 22 264 U1 5/2001

(Continued)

*Primary Examiner* — Lloyd Gall

(74) *Attorney, Agent, or Firm* — Muncy, Geissler, Olds & Lowe, P.C.

(57) ABSTRACT

A locking system is provided whereby at least two locking devices can be actuated with one and the same key. The key has at least two control tracks, via which, in at least two scanning planes lying one behind the other respectively transverse to the insertion direction, the scanning of scanning points provided on the key is possible. Via the scanning points provided in at least one scanning plane, both types of platelet tumblers can be scanned via the mating scanning points thereof and separated, so that the arrangement of one type of the two platelet tumblers in at least one scanning plane can be chosen freely in order to form a multiplicity of locking devices having cylinders cores having an associated cylinder housing and matched to the free choice of the platelet tumblers, which can be actuated with one and the same key.

12 Claims, 19 Drawing Sheets

(56) References Cited

U.S. PATENT DOCUMENTS

| | | | | |
|---|---|---|---|---|
| 7,690,232 | B2 | 4/2010 | Klein et al. | |
| 7,870,771 | B2 | 1/2011 | Mueller et al. | |
| 8,276,419 | B2 * | 10/2012 | Farrenkothen et al. | 70/492 |
| 8,689,596 | B2 * | 4/2014 | Katagiri et al. | 70/492 |
| 8,726,706 | B2 * | 5/2014 | Jacob | 70/409 |
| 8,826,707 | B2 * | 9/2014 | Habecke | 70/357 |
| 8,966,949 | B2 * | 3/2015 | Habecke | E05B 19/0017 70/358 |
| 2006/0000251 | A1 | 1/2006 | Ceron et al. | |
| 2006/0201216 | A1 * | 9/2006 | Gil | 70/492 |
| 2009/0025442 | A1 * | 1/2009 | Klein et al. | 70/492 |
| 2009/0266123 | A1 * | 10/2009 | Mueller | E05B 19/0029 70/348 |

FOREIGN PATENT DOCUMENTS

| | | | |
|---|---|---|---|
| DE | 20 2005 010 309 | U1 | 12/2005 |
| DE | 10 2005 042 617 | A1 | 3/2007 |
| DE | 10 2005 042 618 | A1 | 3/2007 |
| DE | 10 2007 014 900 | A1 | 10/2008 |
| DE | 10 2010 052 473 | A1 | 6/2011 |

* cited by examiner

LOCKING SYSTEM

This nonprovisional application is a continuation of International Application No. PCT/EP2010/007173, which was filed on Nov. 26, 2010, and which claims priority to German Patent Application No. DE 10 2009 056 236.2, which was filed in Germany on Nov. 28, 2009, and which are both herein incorporated by reference

BACKGROUND OF THE INVENTION

1. Field of the Invention

The invention relates to a locking system. The field of application of the invention is directed at locking devices for motor vehicles, which according to the invention form a locking system of several locking devices.

2. Description of the Background Art

From DE 199 44 070 C2 a locking device is known with a key produced for the locking device, wherein the key has surface sides and narrow sides, on which code tracks are arranged on both surface sides of the key in a rotationally symmetrical manner to the longitudinal axis of the key. On each of the two surface sides a profile typifying the key is respectively attached in the region of an edge. These profiles on both surface sides of the key are likewise arranged in a rotationally symmetrically manner to one another. Through the rotationally symmetrical arrangement of the code tracks and the profiles, the key can be inserted into the key channel of a lock cylinder in both possible insertion positions. The profile typifying the key is thereby sunk into the key on at least one of the narrow sides in the form of a groove closed on three sides, and the groove is closed towards the surface sides of the key.

DE 10 2005 042 617 A, which corresponds to U.S. Pat. No. 7,690,232, describes a locking device, likewise composed of a lock cylinder and a key. A cylinder core, which has tumblers, rotatably supported in a cylinder housing belongs to the lock cylinder. The coding of the key is generated by a profiled recess, which extends in the longitudinal direction of the key. The individual tumblers have scanning points, which generate a countercoding corresponding to the key coding. In order to guarantee a higher degree of safety with respect to the locking device being forced open, it is proposed to provide a new beveled edge coding in the corner strips of the edge profile of the key. This is composed of bevel cuts of differing depth. A bevel scanning point in at least one tumbler is assigned to one section of the beveled edge coding. This tumbler then acts as a beveled tumbler, which is additionally added to the tumblers of the standard configuration. The variation variety of the key can thus be increased.

From DE 10 2005 042 618 A, which corresponds to U.S. Pat. No. 7,870,771, a locking device is known, in which there are profiled recesses extending in the longitudinal direction of the key, which recesses produce a pair of scanning points for coding the key for each tumbler. Accordingly, each tumbler has a pair of cooperating scanning points, which have a corresponding countercoding. For an improved coding, it is proposed to arrange the one of the two scanning points on the one side surface of the key, while the other is located on the adjacent side surface. This pair of scanning points is produced by an angular recess in the two side surfaces, between which then a web remains in the corner region of the edge profile of the key. Opposite web flanks then are used for the coding of the key, which is why the web is to be considered as a code web. The tumblers have a cutout, which in case of use grips around the code web of opposite web flanks. The cutout border then serves as a cooperating scanning point of the respective tumbler.

Finally, DE 10 2007 014 900 A1 is known. The locking device likewise comprises a key and a lock cylinder. The lock cylinder is composed of a stationary cylinder housing and a cylinder core, rotatably supported therein. In order to increase the safety with respect to being forced open, it is proposed in the cylinder core to use two types of plate tumblers, the displacements of which point in two radial directions differing from one another. The key has flat outer surfaces arranged at an angle to one another, to which the two types of plate tumblers can be displaced in a parallel manner. Each of the two adjacent outer surfaces has its own linear control track, which varies for coding the key in adjacent key sections transverse to the key longitudinal direction. Accordingly, the plate tumblers have a pair of cooperating scanning points arranged in a defined position, which, when the key is inserted, interact with the associated control track and produce a countercoding in the lock cylinder analogous thereto. Each of the two types of plate tumblers engages on its own control track.

Due to the increased use of electronic access systems, in future mechanical locking systems will be used increasingly in redundancy. However, this means an increase in demands for anti-theft measures, since the classic attack always relates to the mechanical system first, if there is no longer any possibility of prevailing electronically.

SUMMARY OF THE INVENTION

It is therefore an object of the invention in an embodiment to provide a variable locking system, which is characterized by a high variability of possible locking devices belonging to a locking system, wherein it is possible to embody each locking device in a variable manner in order to provide a high degree of safety with respect to being forced open.

In an embodiment, two locking devices of a locking system can be actuated with one and the same key, wherein the key in the insertion direction can be inserted axially into a key channel of a cylinder core of a lock cylinder of the respective locking device, whereby at least two types of plate tumblers arranged in the cylinder core are radially displaceable to the axial cylinder axis and can be separated in the cylinder core such that the cylinder core is freely rotatable with respect to a cylinder housing, to which end the key has at least two control tracks, by means of which the scanning of scanning points provided on the key is possible in at least two scanning planes lying one behind the other respectively transverse to the insertion direction.

To increase the safety with respect to being forced open and to increase variability it is provided that both types of plate tumblers can be scanned and separated by means of a key in at least one of the at least two scanning planes, so that the arrangement of one type of the two plate tumblers in at least this one scanning plane is freely selectable in order to embody a multiplicity of locking devices with cylinder cores, adapted to the free selection of the plate tumblers, with associated cylinder housings, which can be actuated with one and the same key.

Five locking systems in five different embodiments, in part in several embodiment variants, which respectively follow the features of claim 1, are explained in greater detail below based on the above-mentioned prior art.

A locking system has a key, by means of which several, at least two locking devices, which are usually embodied as a lock cylinder, can be actuated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1A:
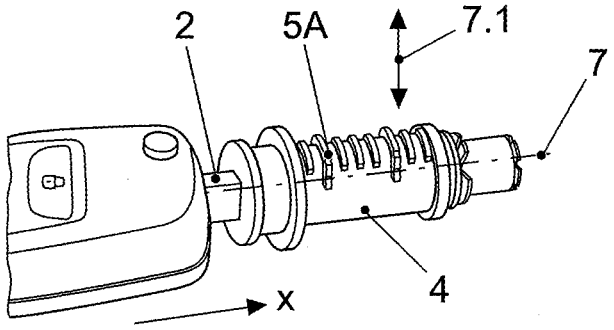
FIG. 1A Prior Art
FIGS. 1A, 1B, 2A, 2B, 3 show locking devices according to the prior art.
Figure 1B:
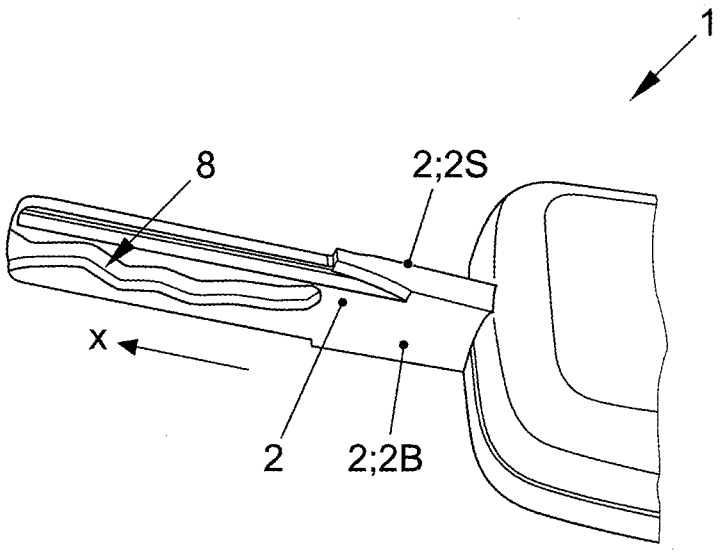
FIG. 1B Prior Art

FIGS. 1A and 1B show a locking device 1 according to the prior art. A key bit of a key 2 is embodied from an edge profile with outer surfaces 2B, 2S running at an angle to one another. The key bit of the key 2 has one wide and one narrow outer surface 2B, 2S. On the wide outer surface 2B a coding track 8 is arranged as a first control track in the form of a control groove.

In the explanation of the prior art and the explanation of the invention below the term "key" refers to the key bit As FIG. 1A shows, the locking device 1 has a cylinder core 4, which is arranged in a cylinder housing 3, not shown, in a rotatable manner. In the cylinder core 4, plate tumblers 5 are provided in recesses arranged for this purpose. In FIG. 1A, plate tumblers of the type 5A are arranged, the shape of which is discussed in detail later.

These plate tumblers 5A move with respect to the axial cylinder axis 7 of the cylinder core 4 in a spring loaded manner by an arranged spring element 3A in the radial direction, according to FIG. 1 by way of example in a first radial direction of movement 7.1. The spring element 3A engages a projection 5-1 of the plate tumblers 5A.

Several of such spring-loaded plate tumblers 5 of type 5A are arranged in notional scanning planes lying one behind the other in the direction of the cylinder axis 7, lying transversely to the cylinder axis.

With the insertion of the key 2 into the cylinder core 4 in an insertion direction E, the key 2 separates the plate tumblers 5A respectively against a spring force of associated spring elements, not shown, such that the plate tumblers 5A are guided out of blocking recesses or blocking channels of the cylinder housing 3 arranged in the cylinder housing 3 or in a freewheel sleeve 4A so that the cylinder core 4 or the cylinder core 4 in the freewheel sleeve 4A is rotatable with respect to the cylinder housing 3, whereby the locking device 1 can be actuated. The coding, that is, the separation of the plate tumblers 5A takes place in the prior art via the control groove 8, which in FIG. 1B is arranged on the wide side 2B of the key 2.

If a control groove 8 is also arranged in a mirror image manner on the opposite side of the wide key side 2B, the key according to the prior art of FIG. 1A, 1B is a reversible key, which according to FIG. 1A can be inserted into the cylinder core with its narrow side 2S in an interchangeable manner, so that one of the two control grooves 8 lying opposite one another on the wide side 2B always takes over the coding, wherein the same effect is respectively achieved.

Regardless of which of the narrow sides 2S according to FIG. 1A lies in the first radial direction of movement 7.1, it is thus ensured that one of the two control grooves 8 separates the plate tumblers of the type 5A and the locking device 1 can be actuated. The control groove 8 is thereby embodied such that the control groove 8 for each plate tumbler 5A provides precisely one scanning point along the cylinder axis 7 for respectively one cooperating scanning point of the plate tumbler 5A.

Figure 2A:
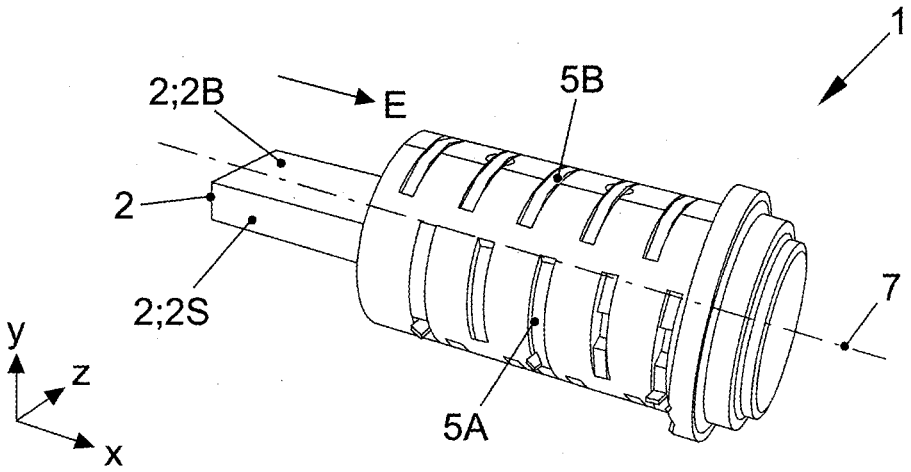
FIG. 2A Prior Art
Figure 2B:
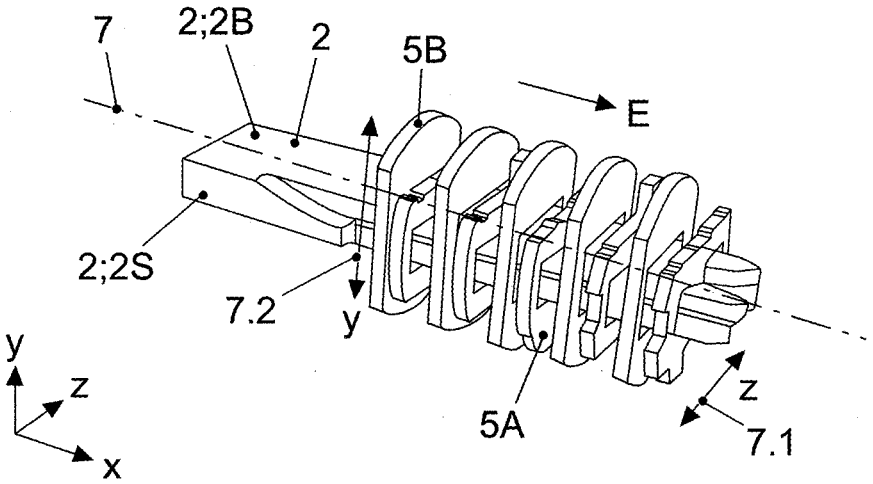
FIG. 2B Prior Art

FIGS. 2A, 2B show a further developed solution according to the prior art. The key 2 is likewise embodied as a rectangular profile and has respectively one narrow side 2S and respectively one wide side 2B. The cylinder core 4 has cutouts, which can be spaced from one another in the radial direction in a first and second radial direction of movement 7.1, 7.2 with respect to the cylinder axis 7. The plate tumblers 5 of the first type 5A are displaceable in the first radial direction of movement 7.1. The plate tumblers 5 of the second type 5B in the exemplary embodiment are displaceable offset by 90° in a second radial direction of movement 7.2. The shape of the plate tumblers 5A, 5B will be dealt with in greater detail in connection with the invention.

As FIG. 2B makes clear, the plate tumblers 5A analogously to FIGS. 1A, 1B, are displaced in the radial direction of movement 7.1 via a first control track 8, in the manner of a control groove, wherein the control groove 8 here too lies on the wide side 2B of the key 2.

The plate tumblers 5 of the second type 5B are displaced by a second control track 9 in the manner of a control rib, wherein this control rib 9 is arranged on the narrow side 2S of the key 2.

If the key 2 is inserted in the insertion direction E in the cylinder core 4 shown in FIG. 2A, on the one hand the control groove 8 and on the other hand the control rib 9 ensure that the plate tumblers 5A, 5B here too are respectively displaceable against the force of an associated spring element (not shown) inside the cylinder core 4 or inside a free-turning sleeve 4A in the cylinder core 4, so that the plate tumblers 5A, 5B can be moved out of blocking recesses or blocking channels (not shown) of the cylinder housing 3 surrounding the cylinder core 4 or the free-turning sleeve 4A arranged in the cylinder housing 3, whereby the cylinder core 4 is rotatable with respect to the cylinder housing 3 and the locking device 1 can be actuated by rotating the cylinder core 4 with respect to the cylinder housing 3.

The control tracks 8, 9, that is, the control groove and the control rib, are embodied such thereby that, viewed in the direction of the cylinder axis 7, in the different notional planes lying in the insertion direction E transverse to the cylinder axis 7, in the control groove 8 and on the control rib 9 in each plane precisely one scanning point of the key 2 for only one type of plate tumbler 5A or 5B is provided. In each scanning plane only one scanning point is embodied on the key, which scanning point corresponds to a cooperating scanning point on the plate tumbler 5A or 5B. Through the shaping of the control groove 8 and of the control rib 9 it is established from the start which type of plate tumbler 5A or 5B in the respective scanning plane can be scanned by precisely one scanning point present in the scanning plane. This arrangement restricts the variability of the arrangement of the plate tumblers in the respective scanning plane and limits the safety with respect to being forced open.

In the first scanning plane the control groove 8 scans the first plate tumbler 5A. The control rib 9 does not have any function in the first scanning plane. In the second scanning plane the control rib 9 scans the first plate tumbler of the second type 5B. The control groove 8 then has no function here. In each scanning plane only one scanning point is always provided on the key 2 for one type of plate tumbler 5A or 5B, whereby it is once again clear that the coding possibilities or separating possibilities are limited to the number of plate tumblers 5A, 5B according to the number of the scanning planes present.

If a control groove 8 is likewise arranged in a mirror image manner on the opposite side of the wide key side 2B and a control rib 9 is likewise arranged in a mirror image manner on the opposite side of the narrow key side 2C, the key according to prior art of FIGS. 2A, 2B is a reversible key, which according to FIGS. 2A, 2B can be inserted into the cylinder core 4 with its narrow side or its wide side 2S, 2B interchangeably, so that one of the two opposite control grooves 8 and control ribs 9 always takes over the coding, wherein the same effect is achieved.

Regardless of which of the opposite narrow sides 2S according to FIG. 2A lies in the radial shift point direction 7.1, it is thus ensured that one of the two control grooves 8 separates the plate tumblers 5A and one of the two control ribs 9 separates the plate tumblers 5B, whereby the locking device 1 can be actuated.

Figure 3:
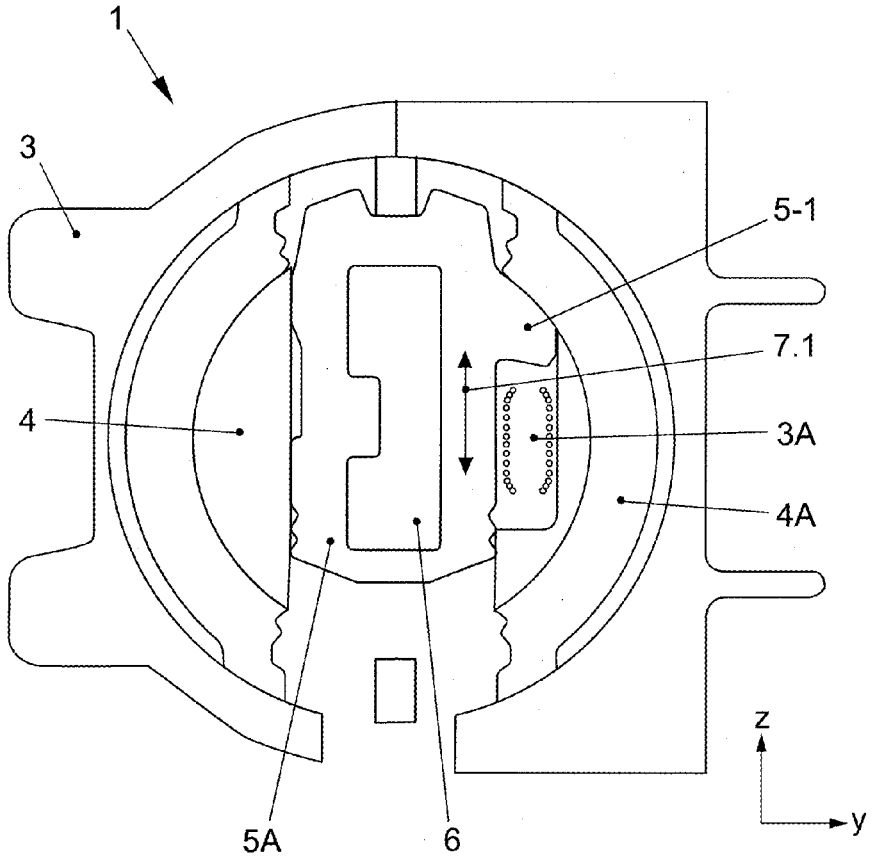
FIG. 3 Prior Art

FIG. 3 shows a locking device 1 according to FIG. 1A, 1B or FIG. 2A, 2B in a sectional image. In the cylinder housing 3 the rotatable cylinder core 4 in the exemplary embodiment lies inside a free-turning sleeve 4A, wherein the locking device 1 has been cut in the plane in which a plate tumbler 5 of the type 5A lies. Locking devices without free-turning sleeve 4A are likewise previously known.

The plate tumbler of the first type 5A is displaceable by the key 2, which can be inserted into the key channel 6, in a first radial direction of movement 7.1.

In FIG. 3 the plate tumbler of the first type 5A is guided out of the cylinder core 4 so that the locking device 1 cannot be locked, since the plate tumbler 5A indirectly blocks the cylinder core 4 with respect to the cylinder housing 3 visible here. The indirect blocking is carried out via the free-turning sleeve 4A, the function of which is known per se.

The following invention can be used for locking devices 1, regardless of whether a direct blocking takes place without free-turning sleeve 4A or an indirect blocking—for example via the free-turning sleeve 4A shown in FIG. 3.

If the key 2 (not shown) is inserted into the key channel 6, the plate tumbler 5A is moved downwards in the radial direction of movement 7.1 according to FIG. 2, so that the cylinder core 4 can be rotated with respect to the cylinder housing 3. The movement of the plate tumbler 5A is carried out against the force of the diagrammatically represented spring element 3A. The projection 5-1 presses against the spring element 3A respectively assigned to each plate tumbler of the first type 5A. The same procedure takes place with the plate tumbler 5 of second type 5B, which, however, is displaced in a different radial direction of movement 7.2.

In the following description of the figures, identical reference characters are always used for identical components.

The arrangement of a vehicle seat inside a motor vehicle and the usual direction of travel thereof determine the following direction data. In or against the direction of travel corresponds to the x direction, the vertical direction in a vehicle is established with the z direction, wherein the axes run transversely to the direction of travel in the y direction.

The description with x, y, z direction data are only by way of example, however, and can change depending on the arrangement of a locking system in the motor vehicle and thus changeable direction of the key channel of the locking devices of the respective locking system.

In order to be able to specify displacement directions in a directionally neutral manner, the axial direction of the cylinder axis 7 is defined, starting from which the first radial and second radial direction of movement 7.1, 7.2 is fixed for the plate tumblers 5A, 5B, 5C, 5D.

Regarding the Cartesian coordinates of FIGS. 1A through 3. An insertion direction E of the key 2 can take place, for example, in the x direction. The key channel 6 is thereby aligned such that in a motor vehicle the wide side 2B runs in the vertical direction in the z direction and the narrow side 2B of the key 2 runs in the y direction. That means that the plate tumblers 5 of the first type 5A in a locking device 1 of this type move in the first radial direction of movement 7.1 in the z direction and the plate tumblers 5 of type 5B run in the second radial direction of movement 7.2 transversely to the direction of travel in the y direction. If the insertion direction E changes, the Cartesian coordinates also change accordingly.

Furthermore, a first cutting plane $D_{x/z}$ is defined, which cuts the key 2 according to FIG. 2B along its wide outer sides 2B, 2B' in the x/z plane. The control tracks 9, 10, 14 or 9', 10', 14' on the narrow outer sides 2S, 2S' of the key are thus cut notionally into two halves according to the following description of the invention (see, e.g., Figs. 5A-5J, 6A-6I and 7A-7F).

Figure 4A:
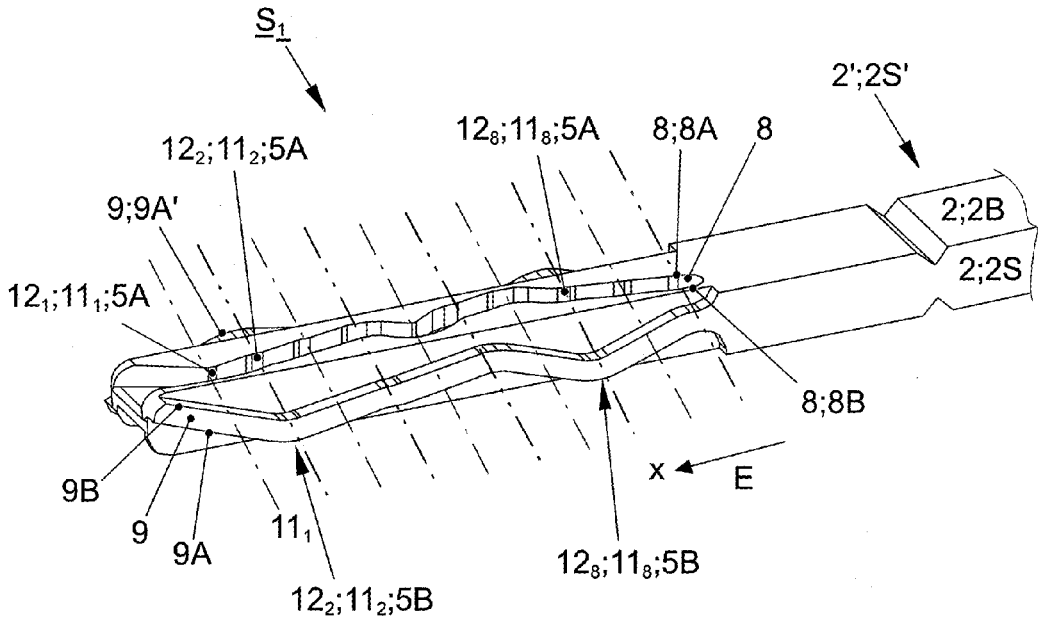
FIGS. 4A, 4B, 4C, 4D, 4E, 4F show a first locking system according to an embodiment of the invention with a first and second control track arranged on a key, in which in each or in every other scanning plane of the cylinder core optionally a first or a second type of plate tumbler can be scanned.
Figure 4B:
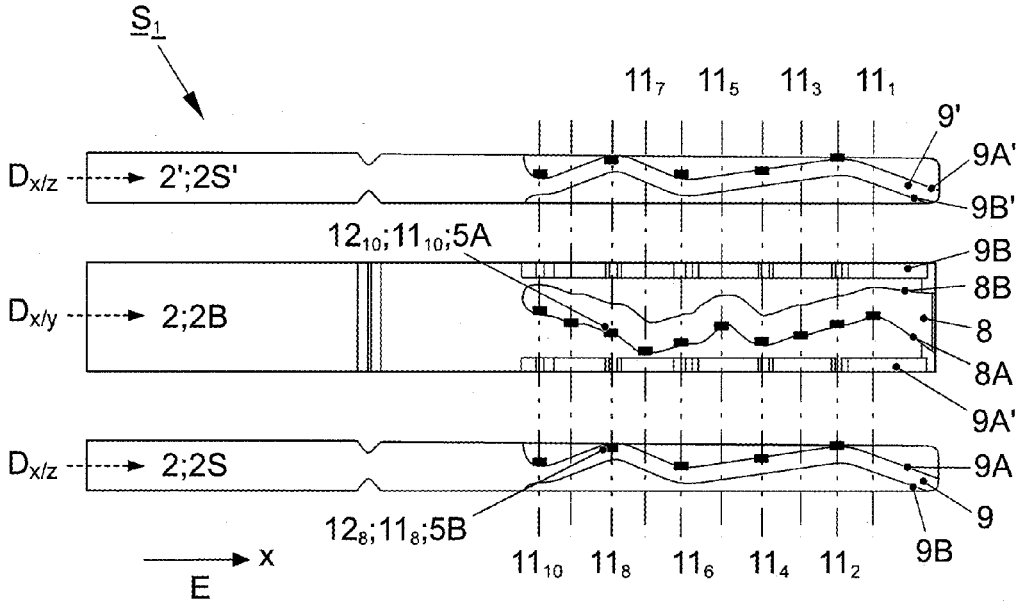
Figure 5A:
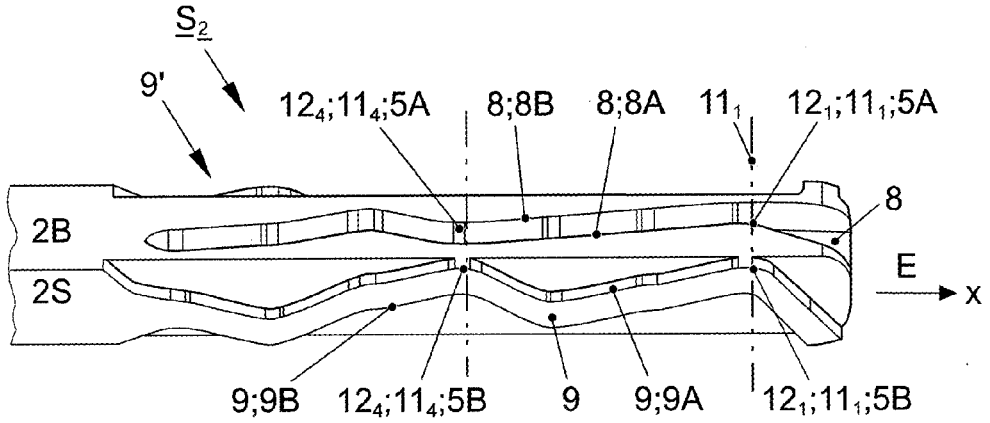
FIGS. 5A, 5B, 5C, 5D, 5E, 5F, 5G, 5H, 5I, 5J show a second locking system according to an embodiment of the invention with the first and second control track arranged on a key, in which in every scanning plane of the cylinder core optionally the first or the second type of plate tumbler can be scanned.
Figure 5B:
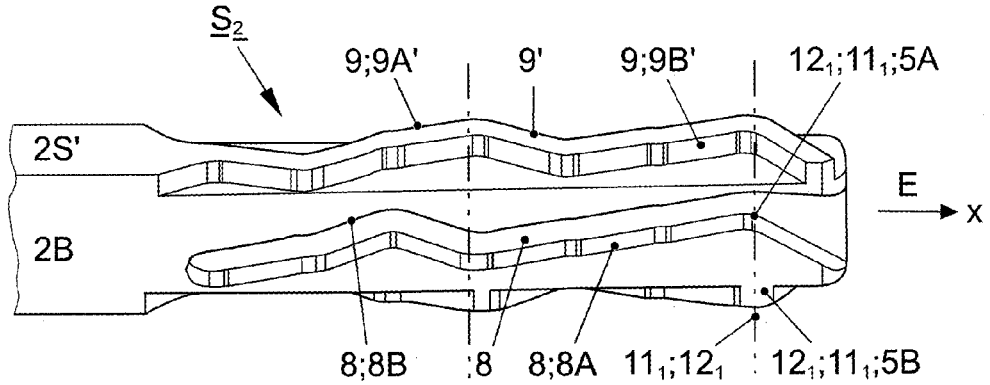
Figure 5C:
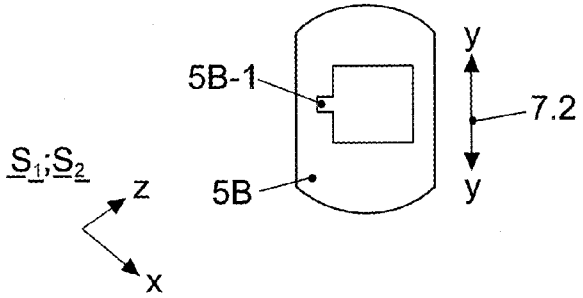
Figure 5D:
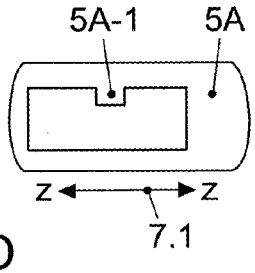
Figure 5E:
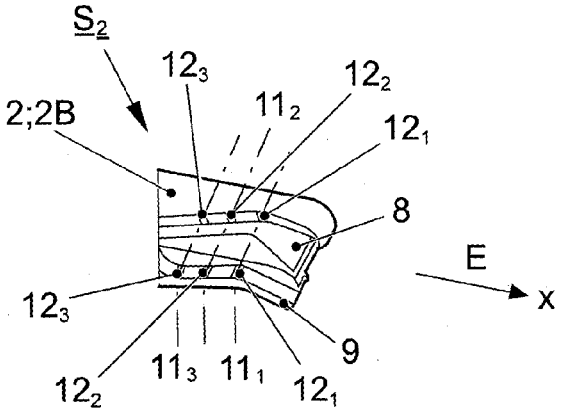
Figure 5F:
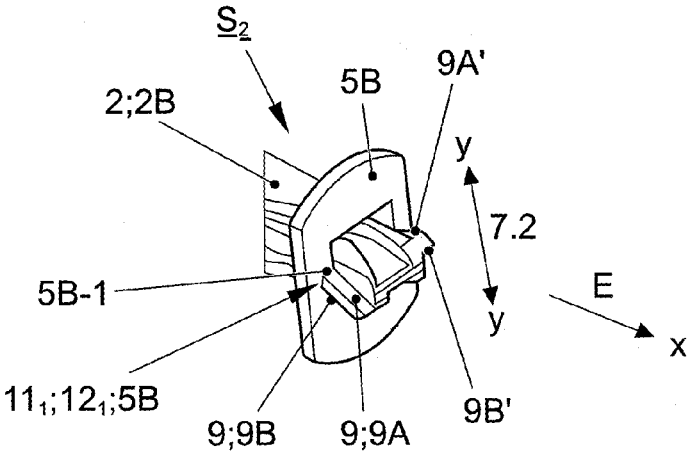
Figure 5G:
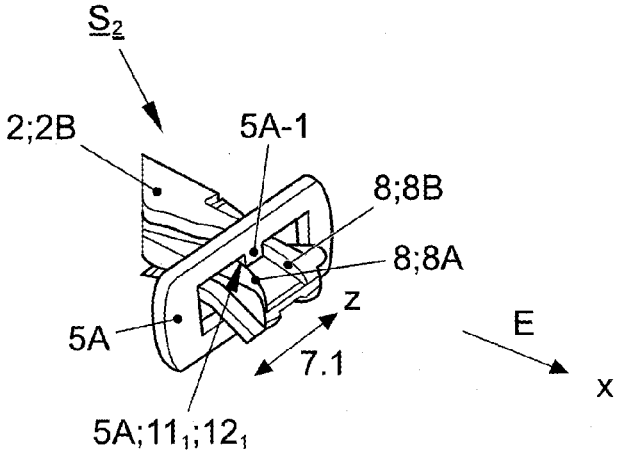
Figure 5H:
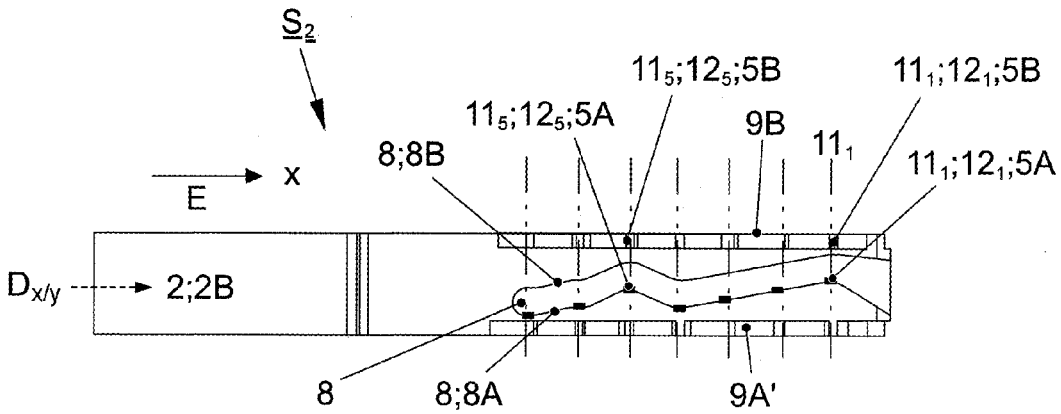
Figure 5I:
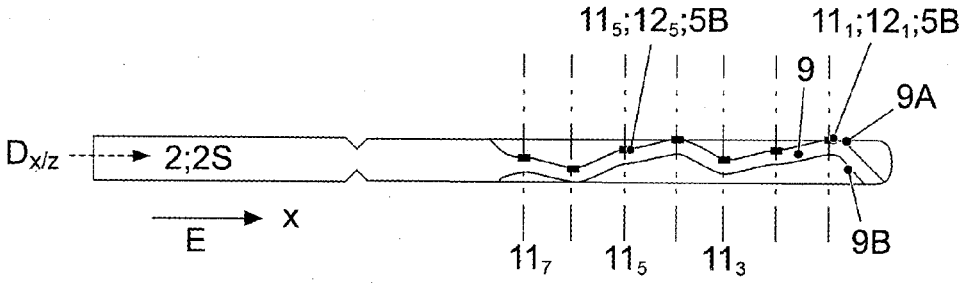
Figure 5J:
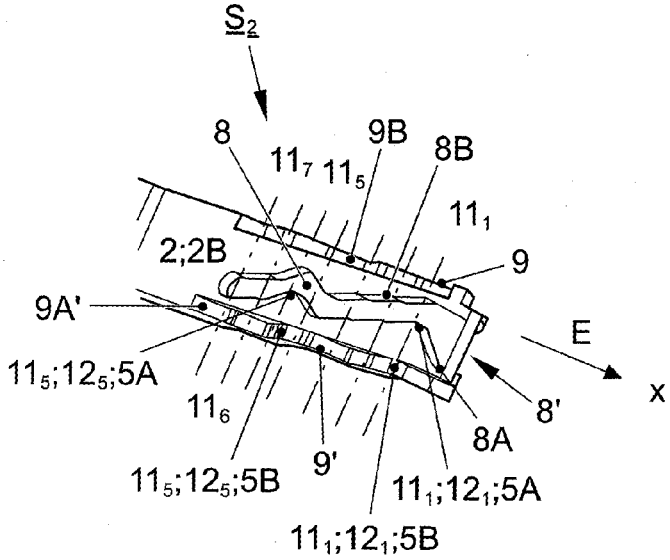

Analogously thereto, a second cutting plane $D_{x/y}$ is defined, which cuts the Key 2 or 8' according to FIG. 2B along its narrow outer sides 2S, 2S' in the x/y plane (see also, e.g. Figs. 4A, 4B and 5J). The control tracks 8 or 8' on the wide outer sides 2B, 2B' of the key 2 are thus notionally cut into two halves according to FIG. 2B (see also, e.g., Figs. 5J and 6E).

In the following five embodiments, the explanation is based on a insertion direction E in the x direction.

The cohesive inventive concept lies in that to increase the safety with respect to being forced open and to increase the variability, at least one locking system $S_n$ ($S_1$, $S_2$, $S_3$, $S_4$, $S_5$) which is respectively described in greater detail below in five embodiments, is provided, that by means of a key 2 in at least one of at least two scanning planes $\mathbf{11}_n$ both types of plate tumblers 5A, 5B or 5A, 5C or 5C, 5D can be scanned and separated so that the arrangement of one type of the two plate tumblers 5A, 5B or 5A, 5C or 5C, 5D in this scanning plane $\mathbf{11}_n$ lying in the cylinder core 4 lying in the insertion direction E of the key 2 in the cylinder core 4 can be freely selected.

In contrast to the prior art, it is therefore not established from the outset which type of plate tumbler is arranged in such a scanning plane $\mathbf{11}_n$.

In the following images the representation of the respective projection 5-1 on the plate tumblers 5A, 5B, 5C, 5D, on which respectively a spring element 3A is supported, is omitted. However, at the end of the description there will be a more detailed discussion of the importance of the spring element 3A, which is shown in FIG. 3, in connection with the present invention.

First Embodiment

First locking system $S_1$ in a first embodiment variant according to FIGS. 4A, 4B.

Firstly, the plate tumblers of the first and second type 5A, 5B according to FIG. 5C and FIG. 5D are presented, which in the locking system $S_1$—but not only there—are used in the different embodiment variants of the first locking system $S_1$. As already described for the prior art, the plate tumblers 5A, 5B respectively have one opening, into which the key 2 can be inserted. The plate tumbler 5A according to FIG. 5D has a tumbler nose 5A-1, which engages into the control groove 8 of the key 2. The plate tumbler 5B according to FIG. 5C has a tumbler groove 5B-1, into which the control rib 9 of the key 2 engages.

FIG. 4*a* shows the key 2 in a perspective view with its narrow side 2S and its wide side 2B. The control groove 8 is arranged on the wide side 2B. The control groove 8 has a first groove flank 8A and a second groove flank 8B. The plate tumbler 5A that can be moved in the first radial direction of movement 7.1 is pressed via the spring element, already described but not shown in further detail here, with its cooperating scanning point in the direction of the first groove flank 8A onto a scanning point provided on the key 2.

The opposite second groove flank 8B is thereby used as a forced guide for the tumbler nose 5A-1 of a plate tumbler 5A.

On the narrow side 2S of the key 2 the control rib 9 is arranged, which has a first rib flank 9A and a second rib flank 9B. The already described associated spring element, not shown, presses the plate tumbler 5 of the type 5B with its cooperating scanning point onto the scanning point of the first rib flank 9A, wherein the second rib flank 9B is used as a forced guide for the plate tumbler.

Thus the visible first groove flank 8A is the control groove of the plate tumbler of the first type 5A and the non-visible lower first rib flank 9A is the control flank of the plate tumbler of the second type 5B.

Along the key axis 7 lying in a rotationally symmetrical manner in the cylinder core 4 in various notional planes $\mathbf{11}_1$ through $\mathbf{11}_{10}$ lying transversely to the key axis 7, scanning points $\mathbf{12}_1$ through $\mathbf{12}_{10}$ are arranged on the first groove flank 8A and on the first rib flank 9A.

The special feature of the first locking system $S_1$ in the first embodiment variant now lies in that in the first scanning plane $\mathbf{11}_1$ only one scanning point $\mathbf{12}_1$ is embodied on the first groove flank 8A for a plate tumbler 5 of the first type 5A. In this first scanning plane $\mathbf{11}_1$ now only one of the two types of plate tumbler 5A, 5B can be queried.

In the second scanning plane $\mathbf{11}_2$ however there is the possibility of querying the plate tumbler 5 of the first type 5A as well as the plate tumbler 5 of the second type 5B via their cooperating scanning points.

"Querying" means the scanning and separating of the cooperating scanning points of a plate tumbler by the scanning points of a key 2 inside the locking device, in particular of a lock cylinder.

To this end, the control rib 9 on the first rib flank 9A has a scanning point $\mathbf{12}_2$ for the plate tumbler 5 of the second type 5B. At the same time on the first groove flank 8A in the second scanning plane $\mathbf{11}_2$ a scanning point $\mathbf{12}_2$ for a plate tumbler 5 of the first type 5A is likewise embodied. Thus according to the invention it is possible in the second scanning plane $\mathbf{11}_2$ to query both types of plate tumblers 5A, 5B. In a cylinder core 4 the user, in establishing which plate tumbler 5 should be arranged in the second scanning plate $\mathbf{11}_2$, can freely choose whether he arranges the plate tumbler 5 of the first type 5A or the plate tumbler 5 of the second type 5B.

In both cases, with the insertion of the key 2 into the key channel 6 it is ensured that in one and the same second scanning plane $\mathbf{11}_2$ a query of the selected arranged plate tumbler of the first type 5A or of the second type 5B is made.

This sequence of scanning points $\mathbf{12}_n$ in a scanning plane $\mathbf{11}_n$ in which in one scanning plane $\mathbf{11}_n$ there is no selection of the type of plate tumbler 5 and in the next scanning plane $\mathbf{11}_n$ there is the selection of the type 5A or 5B of the plate tumblers, is continued in the key 2 shown in FIG. 4A.

To clarify the number of scanning points $\mathbf{12}_n$ that the key 2 offers in a scanning plane $\mathbf{11}_n$, in the different scanning planes $\mathbf{11}_1$ through $\mathbf{11}_{10}$ lines are shown in a one-dot dash sequence, that means possible scanning point $\mathbf{12}_n$ in a scanning plane $\mathbf{11}_n$—or a two-dot dash sequence—that means two possible scanning points $\mathbf{12}_n$ in a scanning plane $\mathbf{11}_n$.

Always when there is a one-dot line sequence, only one scanning point $\mathbf{12}_2$ is provided in this scanning plane $\mathbf{11}_n$ either for a plate tumbler of the first type 5A or the second 5B. If the line is shown with two dots and a dash (two-dot dash sequence), in this scanning plane two scanning points $\mathbf{12}_2$ are provided for an optional arrangement of a plate tumbler 5 of the first type 5A or of the second type 5B. This type of representation is used likewise in all further figures.

Analogously to the second scanning plane $\mathbf{11}_2$ thus in the eighth scanning plane $\mathbf{11}_8$ on the key 2 a scanning point $\mathbf{12}_8$ is provided for the cooperating scanning point of the plate tumbler 5A as well as for the cooperating scanning point of the plate tumbler 5B on the assigned first groove flank 8A or the first rib flank 9A.

This embodiment is also clarified in FIG. 4B. FIG. 4B shows in the center image a plan view of the wide side 2B of the key 2. The respective first groove flank 8A of the control groove 8 has in each of the scanning planes $\mathbf{11}_1$ through $\mathbf{11}_{10}$ scanning points $\mathbf{12}_1$ through $\mathbf{12}_{10}$ lying on the first groove flank 8A, which for clarification are marked by a small rectangle.

One of these scanning points, namely scanning point $\mathbf{12}_{10}$ in the scanning plane $\mathbf{11}_{10}$ for the plate tumbler 5A, is marked separately. Starting from the second scanning plane $\mathbf{11}_2$, on the first rib flank 9A in the respectively second scanning plane $11_4$, $11_6$, $11_8$ and $11_{10}$ a scanning point $12_2$, $12_4$, $12_6$, $12_8$ and $12_{10}$ is embodied. Thus in the respective scanning plane $11_2$, $11_4$, $11_6$, $11_8$ and $11_{10}$ it is freely selectable which of the plate tumblers 5 of the type 5A or 5B should be positioned with its cooperating scanning points in this scanning plane.

This results in the important advantage that the first locking system $S_1$ can be composed of at least two key devices, which are characterized by differently arranged plate tumblers 5A, 5B. For each locking device equipped differently with plate tumblers in this manner, however, the same key 2 can always be used. For example, the same key 2 can be used for a first locking device as a key for a door lock cylinder and on the other hand for a second locking device as a key for an ignition and steering lock cylinder.

The first possibility thereby lies in embodying a locking device in which only plate tumblers 5 of the type 5A are arranged, the cooperating scanning point of which are queried via the scanning points $12_1$ through $12_{10}$ of the first groove flank 8A of the first control track 8.

Furthermore, the second possibility lies in embodying a locking device in which only plate tumblers 5 of the type 5B are arranged, which are scanned via their cooperating scanning points on the scanning points $12_2$, $12_4$, $12_6$, $12_8$, $12_{10}$ of the first rib flank 9A of the second control track 9.

Finally, the third possibility lies in embodying a locking device in which both types of plate tumbler 5A, 5B are arranged, wherein in the scanning planes $11_2$, $11_4$, $11_6$, $11_8$, $11_{10}$ it is variably selectable which of the two plate tumblers 5 of type 5A or of type 5B are arranged, wherein in all possible embodiments the same key 2 can be used for at least two locking devices in order to separate the plate tumblers 5A, 5B via their cooperating scanning points such that the cylinder core 4 is rotatable with respect to the cylinder housing 3.

Moreover, as the top and bottom image of FIG. 4B make clear, the key 2 of the first locking system $S_1$ can be embodied as a reversible key. As is only partially visible in FIG. 4A, on the opposite side of the control rib 9 a control rib 9A' is arranged in a mirror image manner to the second cutting plane $D_{x/y}$.

As is not shown in FIGS. 4A and 4B, in the same way on the opposite side of the key 2 of the first control track 8, a first control track 8' is arranged in a mirror image manner to the first cutting plane $D_{x/z}$ with an opposite first groove flank 8A'.

In the top diagrammatic image of FIG. 4B, starting from the center image of FIG. 4B, the control rib 9', which lies opposite the narrow side 2S of the key 2, is shown lying below on the narrow side 2S' of the key 2'.

In the bottom diagrammatic image of FIG. 4B, starting from the center image of the key 2 of FIG. 4B, the control rib 9 lying at the top on the narrow side 2S is shown.

An arrangement of scanning points $12_n$ (visible in FIG. 4A, the opposite first control track 8' is not visible) on a reversible key are shown by the rectangles in the diagrammatic images of FIG. 4B.

Due to this reversible key embodiment, it is irrelevant how the key 2 is inserted into the elongated key channel 6 provided for this purpose in the insertion direction E. The effects and advantages described are always retained.

With the insertion of the key 2 into a first position, the flanks 8A, 9A are used for scanning the cooperating scanning points of the plate tumblers 5 of the first and of the second type 5A, 5B, (two-track locking system).

With the insertion of the key 2 in a second position (reversible key position), the flanks 8A', 9A' are used for scanning the cooperating scanning points of the plate tumblers 5 of the first and of the second type 5A, 5B (two-track locking system).

First Embodiment

Figure 4C:
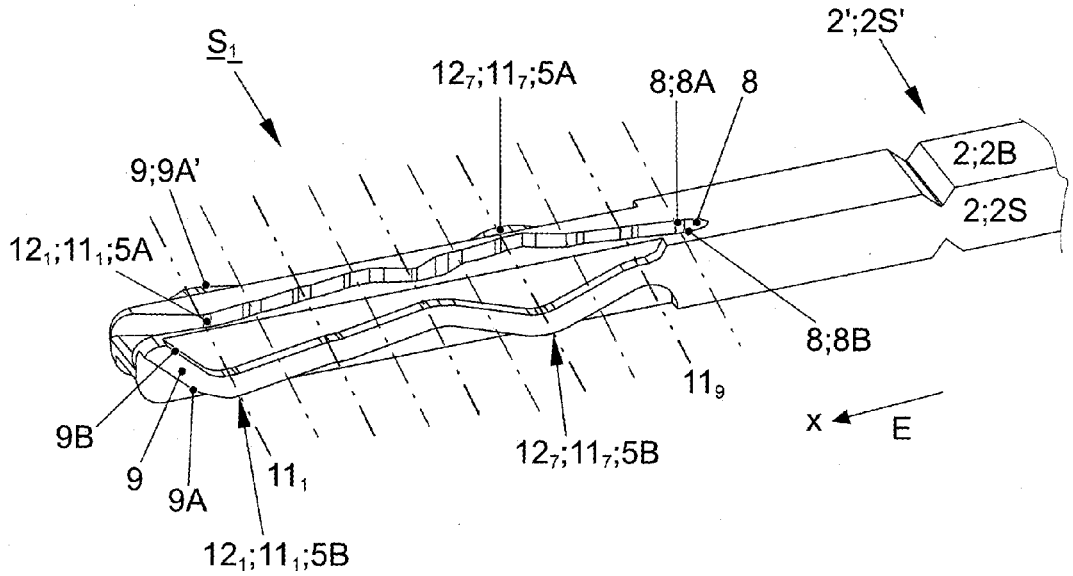
Figure 4D:
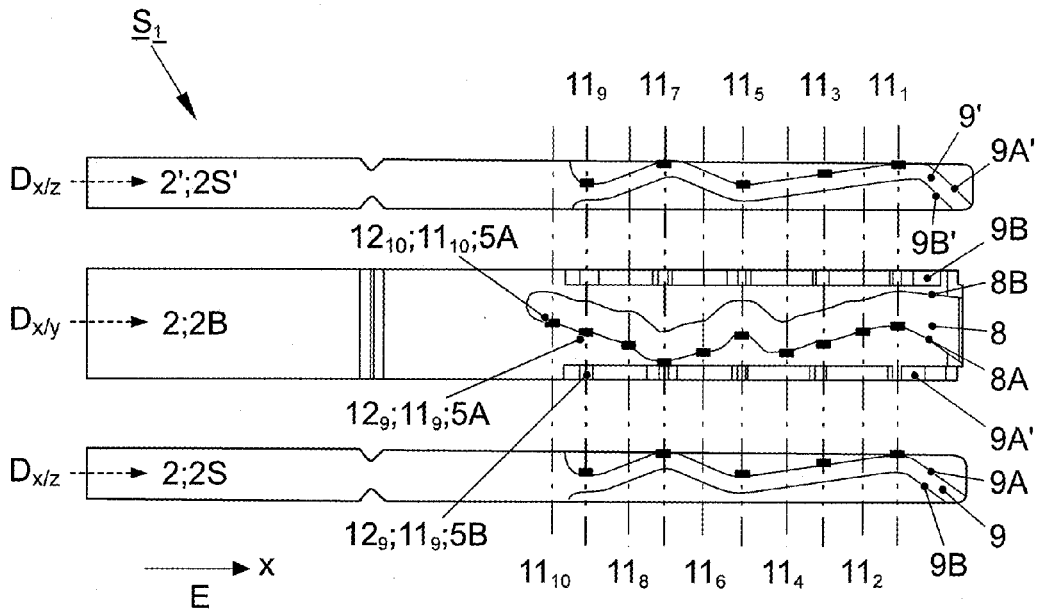

First locking system $S_1$ in a second embodiment variant according to FIG. 4C, 4D.

The special feature of the first locking system $S_1$ in the second embodiment variant, which is shown in FIGS. 4C, 4D, now lies in that on the key 2 in the first scanning plane $11_1$ two scanning points $12_1$ on the first groove flank 8A for a plate tumbler 5 of the type 5A and on the first rib flank 9A for the plate tumbler 5 of the type 5B is embodied. In this first scanning plane $11_1$ thus both types of plate tumblers 5A, 5B can be queried via their cooperating scanning points, wherein a type 5A or 5B has to be selected.

In the second scanning plane $11_2$, now there is only the possibility of querying the plate tumbler 5 of the first type 5A. The control rib 9 does not have a scanning point $12_2$ for the plate tumbler of type 5B on the first rib flank 9A of the second scanning plane $11_2$. In a cylinder core 4 when establishing which plate tumbler 5 should be arranged in the first scanning plane $11_1$ the user can freely choose whether he arranges the plate tumbler 5 of the first type 5A or the plate tumbler 5 of the second type 5B. In both cases with the insertion of the key 2 into the key channel 6 it is ensured that in one and the same first scanning plane $11_1$ a query takes place of the cooperating scanning point of the selected plate tumbler 5A or 5B.

This sequence of scanning points $12_n$ in a scanning plane $11_n$ in which in one scanning plane $11_n$ there is no selection of the type of plate tumbler 5 and in the next scanning planes $11_n$ there is the selection of the type 5A or 5B of the plate tumblers, is continued in the key 2 shown in FIG. 4C. To clarify the number of scanning points $12_n$ in a scanning plane $11_n$, in the different scanning planes $11_1$ through $11_{10}$ with the aid of the lines shown the one-dot dash sequence or the two-dot dash sequence are used again.

Analogously to the first scanning plane $11_1$ thus, for example, in the seventh scanning plane $11_7$ a scanning point $12_7$ is provided for the plate tumbler 5 of the first type 5A as well as for the plate tumbler 5 of the second type 5B on the assigned first groove flank 8A or the first rib flank 9A.

This embodiment is also clarified in FIG. 4D. In FIG. 4D a plan view of the key 2 is shown in the center diagrammatic image. The respective first groove flank 8A of the control groove 8 in each of the scanning planes $11_1$ through $11_{10}$ has scanning points $12_1$ through $12_{10}$ lying on the first groove flank 8A, which for clarification are again marked with a small rectangle. One of these scanning points, namely scanning point $12_9$ in the ninth scanning plane $11_9$ for the plate tumbler 5A, is marked separately.

Starting from the first scanning plane $11_1$, a scanning point $12_3$, $12_5$, $12_7$ and $12_9$ is embodied on the first rib flank 9A in the respectively second scanning plane $11_3$, $11_5$, $11_7$ and $11_9$. Thus in the respective scanning plane $11_3$, $11_5$, $11_7$ and $11_9$ it is freely selectable which of the plate tumblers 5 of the type 5A or 5B should be positioned in this scanning plane and should be queried via the respective cooperating scanning point.

This also results here in the important advantage that the first locking system $S_1$ of the second embodiment variant can be composed of at least two key devices which are characterized by differently arranged plate tumblers 5 of the first and second type 5A, 5B. However, the same key 2 can be used for each of the locking devices provided in this manner.

The first possibility thereby also lies here in embodying a locking device in which only plate tumblers of type 5A are arranged which are queried via the scanning points $\mathbf{12}_1$ through $\mathbf{12}_{10}$ of the first groove flank 8A of the first control track 8.

Furthermore, here too the second possibility lies in embodying the other locking device such that only plate tumblers of the type 5B are arranged, which are scanned on the scanning points $\mathbf{12}_1$, $\mathbf{12}_3$, $\mathbf{12}_5$, $\mathbf{12}_7$, $\mathbf{12}_9$ of the first rib flank 9A of the second control track 9. See, for example, one of these scanning points $\mathbf{12}_9$, $\mathbf{11}_9$ for a plate tumbler 5 of the type 5B of FIG. 4D.

Finally, the third possibility lies in embodying a locking device in which both types of plate tumblers 5A, 5B are arranged, wherein in the scanning planes $\mathbf{11}_1$, $\mathbf{11}_3$, $\mathbf{11}_5$, $\mathbf{11}_7$, $\mathbf{11}_9$ it can be variably selected which of the two plate tumblers of type 5A or of type 5B are arranged, wherein in all possible embodiments the same key 2 can always be used for at least two locking devices in order to separate the plate tumblers 5A, 5B via their cooperating scanning points such that the cylinder core 4 is rotatable with respect to the cylinder housing 3.

Moreover, as the top and bottom diagrammatic image of FIG. 4D make clear, the key of the locking system $S_1$ can be embodied as a reversible key. As is only partially visible in FIG. 4C, on the opposite key side 2', 2S' of the key 2, 2S of the control rib 9 a control rib 9A' is arranged in a mirror image manner to the second cutting plane $D_{x/y}$.

As is not shown in FIGS. 4C and 4D, on the opposite side of the key 2, 2B of the first control track 8, a first control track 8' is likewise arranged in a mirror image manner to the first cutting plane $D_{x/z}$ on the side 2', 2B' with an opposite first groove flank 8A'.

In the top diagrammatic image of FIG. 4D, starting from the center image of FIG. 4C, the control rib 9' lying at the bottom on the narrow side 2S' is shown.

In the bottom image of FIG. 4D, starting from the center image of FIG. 4B, the control rib 9 lying at the top on the narrow side 2S is shown.

The possible visible scanning points $\mathbf{12}_n$ of a reversible key are again shown by the rectangles in the images of FIG. 4D.

Due to this reversible key embodiment, it is irrelevant here too how the key 2 is inserted into the elongated key channel 6 provided for this purpose in the insertion direction E. The effects and advantages described are always retained thereby.

With the insertion of the key in a first position, the flanks 8A, 9A are used for scanning of the cooperating scanning points of the plate tumblers 5 of the first and of the second type 5A, 5B (two-track locking system).

With the insertion of the key 2 in a second position (reversible key position), the flanks 8A', 9A' are used for scanning the cooperating scanning points of the plate tumblers 5 of the first and of the second type 5A, 5B (two-track locking system).

First Embodiment

Figure 4E:
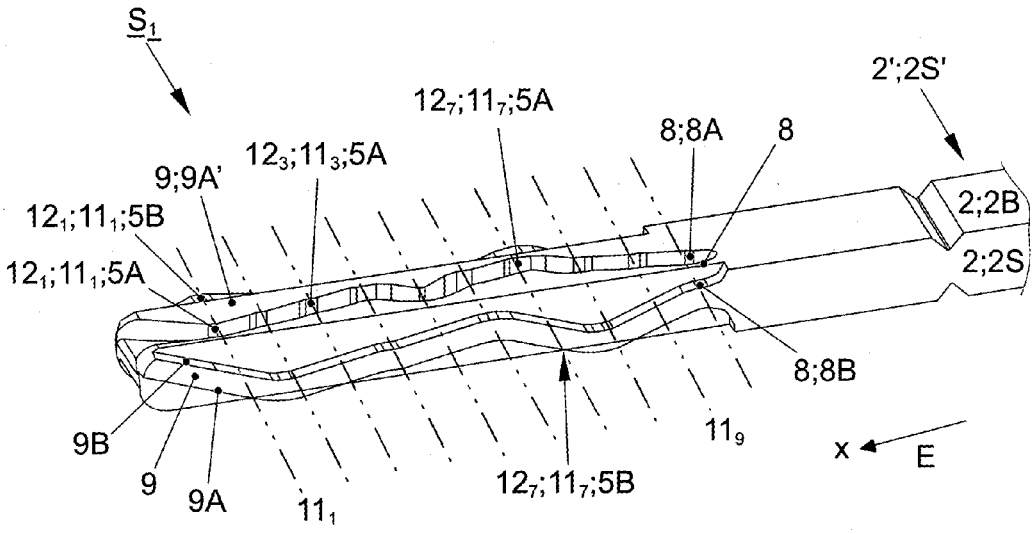
Figure 4F:
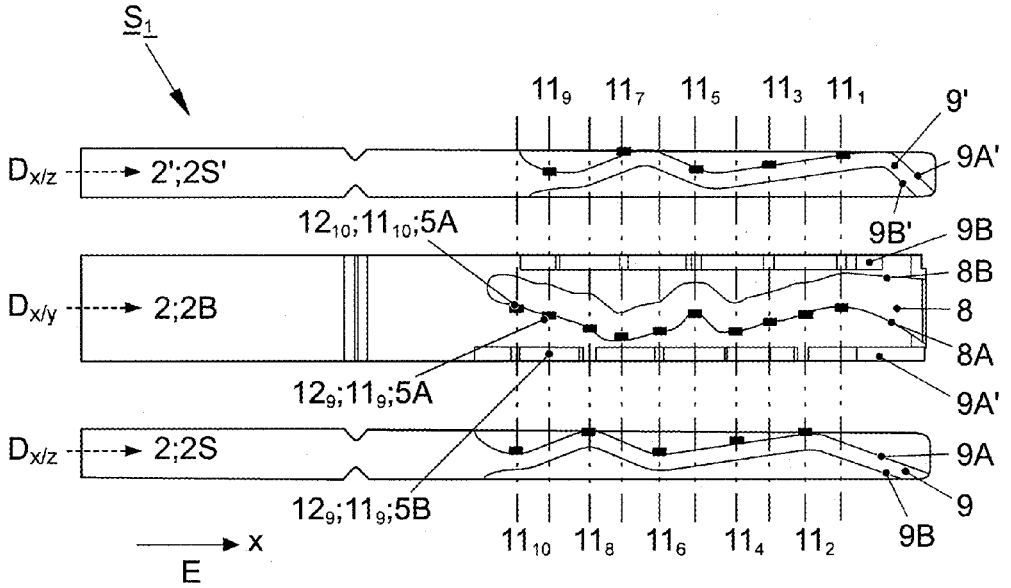

First locking system $S_1$ in a third embodiment variant according to FIGS. 4E, 4F.

The locking system $S_1$ according to FIGS. 4E and 4F corresponds to the second embodiment variant according to FIGS. 4C, 4D, the first control groove 8 is thereby arranged on the opposite wide side 2B' of the key 2 with respect the first cutting plane $D_{x/z}$ in a mirror image manner to the first control groove 8', but the control ribs 9, 9', as the top and bottom image of FIG. 4F clarify, are not embodied in a mirror image manner with respect to the second cutting plane $D_{x/y}$.

With the embodiment of the first locking system $S_1$ according to the third embodiment variant, this results in the first possibility of embodying a locking device in which only plate tumblers of the type 5A are arranged, which are queried via the scanning points $\mathbf{12}_1$ through $\mathbf{12}_{10}$ of the first groove flank 8A or the first groove flank 8A', arranged in a mirror image manner, of the first control track 8, 8'. Then the key 2 can be used as before as a reversible key.

Furthermore, the second possibility here too lies in embodying a locking device in which only plate tumblers of the type 5B are arranged, which are queried at the scanning points $\mathbf{12}_1$, $\mathbf{12}_3$, $\mathbf{12}_5$, $\mathbf{12}_7$, $\mathbf{12}_9$ of the first rib flank 9A of the second control track 9 or the rib flank 9A', not arranged in a mirror image manner, of the second control track 9' via its cooperating scanning point. The key 2 can then no longer be used as a reversible key, however, since the control ribs 9, 9' are not arranged in a mirror image manner.

Finally, the third possibility lies in embodying a locking device in which both types of plate tumblers 5A, 5B are arranged, wherein the plate tumblers 5A, 5B can be variably selected in all scanning planes $\mathbf{11}_1$ through $\mathbf{11}_{10}$, because the plate tumblers 5 of the type 5B can be arranged interchangeably such that the plate tumblers 5 of the type 5B are scanned with their cooperating scanning point in a locking device of the second system S2 once in the scanning planes $\mathbf{11}_2$, $\mathbf{11}_4$, $\mathbf{11}_6$, $\mathbf{11}_8$, $\mathbf{11}_{10}$ in the scanning points $\mathbf{12}_2$, $\mathbf{12}_4$, $\mathbf{12}_6$, $\mathbf{12}_8$, $\mathbf{12}_{10}$ via the first rib flank 9A or in the scanning planes $\mathbf{11}_1$, $\mathbf{11}_3$, $\mathbf{11}_5$, $\mathbf{11}_7$, $\mathbf{11}_9$ in the scanning points $\mathbf{12}_1$, $\mathbf{12}_3$, $\mathbf{12}_5$, $\mathbf{12}_7$, $\mathbf{12}_9$ of another locking device belonging to the second locking system S2 via its cooperating scanning point on the first rib flank 9A' not arranged in a mirror image manner.

Naturally, the plate tumblers 5 of the type 5B for this have to be arranged offset by 180° in every other scanning plane $\mathbf{11}_1$ through $\mathbf{11}_{10}$ so that the tumbler groove 5B-1 can once query the cooperating scanning points of the plate tumblers 5 of the second type 5B via the first rib flank 9A in the scanning planes $\mathbf{11}_1$, $\mathbf{11}_3$, $\mathbf{11}_5$, $\mathbf{11}_7$, $\mathbf{11}_9$ with the scanning points $\mathbf{12}_1$, $\mathbf{12}_3$, $\mathbf{12}_5$, $\mathbf{12}_7$, $\mathbf{12}_9$ and another time the cooperating scanning points of the plate tumblers 5 of the second type 5B via the first opposite rib flank 9A' in the scanning planes $\mathbf{11}_2$, $\mathbf{11}_4$, $\mathbf{11}_6$, $\mathbf{11}_8$, $\mathbf{11}_{10}$ in the scanning points $\mathbf{12}_2$, $\mathbf{12}_4$, $\mathbf{12}_6$, $\mathbf{12}_8$, $\mathbf{12}_{10}$.

In all possible embodiments the same key 2 can always be used for at least two locking devices in order to separate the plate tumblers of the first type 5A and of the second type 5B via the cooperating scanning points such that the cylinder core 4 is rotatable with respect to the cylinder housing 3. The key 2 can no longer be used as a reversible key, however, since the control ribs 9, 9' are not arranged in a mirror image manner.

With the insertion of the key 2, in a first position the flanks 8A, 9A, 9A' are used for scanning the cooperating scanning points of the plate tumblers 5 of the first or of the second type 5A, 5B (three-track locking system).

An insertion of the key 2 in a second position (reversible key position) is not possible due to the non-mirror image arrangement of the control ribs 9, 9'.

Second Embodiment

Second locking system $S_2$ according to FIGS. 5A through 5G in a first embodiment variant.

FIGS. 5A through 5J show a second locking system $S_2$ in a first embodiment variant.

The second locking system $S_2$ is characterized in that in each of the scanning planes $\mathbf{11}_n$ respectively one scanning point $12_n$ is provided for the cooperating scanning point of the plate tumbler 5 of the first type 5A and for the cooperating scanning point of the plate tumbler 5 of the second type 5B.

FIGS. 5C and 5D show both plate tumblers 5 of the first and of the second 5A and 5B, which have already been described in connection with the first locking system $S_1$.

FIGS. 5A and 5B show in each case perspectively a key 2, wherein FIG. 5A shows the front side, the narrow key side 2S and the upper side the wide key side 2B. In FIG. 5B the key 2 is rotated downwards by 90° with respect to FIG. 5A so that the first control track 8, which according to FIG. 5A points upwards, is now aligned towards the viewer, so that the rear narrow opposite side 2S' is now shown at the top.

The control rib 9' lying on the rear side in FIG. 5A, in FIG. 5 is thus visible on the narrow top of the key 2', as narrow outer surface 2S'.

It is clear from the two-dot dash line used in the two figures that on the first groove flank 8A as well as on the first rib flank 9*a* for each scanning plane $11_n$ a scanning point $12_n$ is embodied. The opposite flanks, the second groove flank 8B and the second rib flank 9B, thereby in each case form the forced guide for the tumbler nose 5A-1 of the plate tumblers 5A or for the tumbler groove 5B-1 of the plate tumblers 5B.

It is shown by way of example that in the first scanning plane $11_1$ respectively one scanning point $12_1$ for the cooperating scanning point of the plate tumbler of the first type 5A as well as of the second type 5B can be queried or scanned via the first groove flank 8A or the first rib flank 9A. It is also shown by way of example in the fourth scanning plane $11_4$ that both types of plate tumblers 5A and 5B can be queried via the correspondingly embodied control tracks 8, 9.

This results in turn in the important advantage that the second locking system $S_2$ can be composed of at least two key devices, which are characterized by differently arranged plate tumblers 5 of both types 5A, 5B. The same key 2 can be used for each of the locking devices thus embodied or equipped with plate tumblers. If in each of the notional scanning planes $11_n$ both types of plate tumblers 5A, 5B can optionally be arranged, here too there is a multiplicity going beyond the prior art of variable possibilities of the arrangement of plate tumblers. The safety with respect to being forced open is increased thereby.

If the respective control track 8, 9 is embodied in the opposite control tracks 8', 9' in a mirror image manner with respect to the first and second cutting plane $D_{x/z}$, $D_{x/y}$, a reversible key is always produced so that the key 2 can be used in at least two locking devices in a first position and in a second position as a reversible key.

With the insertion of the key 2 in a first position, the flanks 8A, 9A are used for scanning the cooperating scanning points of the plate tumblers 5 of the first and of the second type 5A, 5B (two-track locking system).

With the insertion of the key 2 in a second position (reversible key position), the flanks 8A', 9A' (not shown in further detail in FIGS. 5A, 5B) are used for scanning the cooperating scanning points of the plate tumblers 5 of the first and of the second type 5A, 5B (two-track locking system).

FIG. 5E shows for the second locking device the first three scanning planes $11_1$,$11_2$, $11_3$ and clarifies the possible scanning points $12_1$, $12_2$, $12_3$ arranged in the first and second control track 8, 9 in a scanning plane $11_1$, $11_2$, $11_3$.

FIG. 5F shows the second plate tumbler 5B displaceable in the radial direction of movement 7.2, which in the first scanning plane $11_1$ on the first rib flank 9A of the second control track 9 forms a scanning point $12_1$. The first rib flank 9A and the force guiding second rib flank 9B engage in the tumbler groove 5B-1 and control the plate tumbler of the second type 5B via its cooperating scanning point in the radial direction of movement 7.2, which in the exemplary embodiment according to the direction definitions can lie in a y direction, for example.

FIG. 5G shows analogously thereto the plate tumbler of the first type 5A, which in the first radial direction of movement 7.1 is separated or scanned by the first control groove 8 via the first groove flank 8A and the force guiding second groove flank 8B by the insertion of the key 2. This results, as can be seen in comparison with FIG. 5F, in the optional arrangement of a scanning point $12_1$ in the first scanning plane $11_1$ for the cooperating scanning point of a plate tumbler 5 of the first type 5A instead of the second type 5B (FIG. 5F).

If the radial direction of movement of the plate tumbler 5 of the second type 5B lies in the direction of movement 7.2, for example in a vehicle in the y direction, the direction of movement of the plate tumbler 5 of the first type 5A, for example, is arranged according to the direction of movement 7.1 orthogonally thereto in the z direction.

If a key 2 for example is inserted into a key channel in the vehicle direction x and if the narrow side 2S of the key 2 lies horizontally in the y direction in a vehicle, the plate tumbler 5 of the type 5B is displaced horizontally in the y direction according to the direction of movement 7.2 and the plate tumbler 5 of the type 5A is shifted in the vertical direction in the z direction in the direction of movement 7.1.

Second Embodiment

Second locking system $S_2$ according to FIGS. 5H through 5J in a second embodiment variant.

According to FIGS. 5H, 5I, 5J, however, there is also the possibility of embodying the second locking system $S_2$ such that the second control track 9 and the opposite control track 9' are embodied on the narrow outer sides 2S, 2S' of the key 2 not in a mirror image manner with respect to the second cutting plane $D_{x/y}$.

This second embodiment variant of the second locking system is clarified in FIGS. 5H, 5I, 5J.

This in turn results in the following possibilities for embodying the locking devices.

In order now to also follow the inventive concept inside the second locking system $S_2$, the second locking system $S_2$ in the second embodiment variant is likewise characterized in that in at least one, here in each of the scanning planes $11_n$ respectively one scanning point $12_n$ is provided for a plate tumbler 5 of the first type 5A and for a plate tumbler 5 of the second type 5B, wherein however due to the non-mirror image arrangement of the control rib 9, 9', a reversible key cannot be produced in every case, as is explained below.

FIG. 5I shows in the diagrammatic image only one of the control ribs 9 on the narrow outside 2S of the key 2. The image of FIG. 5I based on FIG. 5H shows the control rib 9 lying at the top on the narrow side 2S of the key 2.

The opposite control rib 9' is not arranged in a mirror image manner with respect to the second cutting plane $D_{x/y}$, as FIG. 5J shows.

On the one hand, a scanning point $12_1$, $12_2$, $12_3$, $12_4$, $12_5$, $12_6$, $12_7$ can be embodied via the first control groove 8A of the first control track 8 and the first control rib 9A of the second control track 9 in each of the scanning planes $11_1$, $11_2$, $11_3$, $11_4$, $11_5$, $11_6$, $11_7$.

On the other hand, a scanning point $12_1$, $12_2$, $12_3$, $12_4$, $12_5$, $12_6$, $12_7$ can be embodied via the first opposite control groove 8A' of the first control track 8' and the first control rib 9A' of the second opposite control track 9' in each of the scanning planes $\mathbf{11}_1$, $\mathbf{11}_2$, $\mathbf{11}_3$, $\mathbf{11}_4$, $\mathbf{11}_5$, $\mathbf{11}_6$, $\mathbf{11}_7$.

If in one possibility only plate tumblers of the first type 5A are arranged in a locking device, these are queried respectively via the scanning points $\mathbf{12}_1$ through $\mathbf{12}_7$ of the first groove flank 8A or 8A' of the first control track 8 or the opposite first control track 8', which are arranged in a mirror image manner. A locking system $S_2$ is thus produced for several locking devices of this type, in which the key 2 is still embodied as a reversible key.

There is also the second possibility of arranging only plate tumblers of the second type 5B in each of the consecutive scanning planes $\mathbf{11}_1$, $\mathbf{11}_2$, $\mathbf{11}_3$, $\mathbf{11}_4$, $\mathbf{11}_5$, $\mathbf{11}_6$, $\mathbf{11}_7$, which are either arranged on the scanning points $\mathbf{12}_1$, $\mathbf{12}_2$, $\mathbf{12}_3$, $\mathbf{12}_4$, $\mathbf{12}_5$, $\mathbf{12}_6$, $\mathbf{12}_7$ of the first rib flank 9A of the second control track 9 or for a further locking device only plate tumblers of the second type 5B in each of the consecutive scanning planes $\mathbf{11}_1$, $\mathbf{11}_2$, $\mathbf{11}_3$, $\mathbf{11}_4$, $\mathbf{11}_5$, $\mathbf{11}_6$, $\mathbf{11}_7$, which are scanned at the scanning points $\mathbf{12}_1$, $\mathbf{12}_2$, $\mathbf{12}_3$, $\mathbf{12}_4$, $\mathbf{12}_5$, $\mathbf{12}_6$, $\mathbf{12}_7$ of the rib flank 9A', not arranged in a mirror image manner, of the second control track 9'. However, the key can then no longer be used as a reversible key, since the control ribs 9, 9' are not arranged in a mirror image manner with respect to the second cutting plane $D_{x/y}$.

Starting from the second possibility described above, another alternative embodiment lies in arranging the plate tumblers 5 of the second type 5B such that the plate tumblers 5 of the second type 5B with their cooperating scanning points in a locking device of the second system $S_2$ is scanned once in a scanning plane $\mathbf{11}_n$ via the first rib flank 9A and in an identical scanning plane $\mathbf{11}_n$ of another locking device belonging to the second locking system $S_2$ via its cooperating scanning point by the first rib flank 9A' not arranged in a mirror image manner. This is rendered possible by the direction of action of the spring element, which presses the plate tumblers 5 in the one or the other direction of the radial direction of movement 7.2. This key 2 however cannot be used as a reversible key.

Finally, the third possibility lies in embodying a locking device in which both types of plate tumblers 5A, 5B are arranged, since the plate tumblers 5 of the first and of the second type 5A, 5B in the consecutive scanning planes $\mathbf{11}_1$, $\mathbf{11}_2$, $\mathbf{11}_3$, $\mathbf{11}_4$, $\mathbf{11}_5$, $\mathbf{11}_6$, $\mathbf{11}_7$ can be arranged in a variably selectable manner on the scanning points $\mathbf{12}_1$, $\mathbf{12}_2$, $\mathbf{12}_3$, $\mathbf{12}_4$, $\mathbf{12}_5$, $\mathbf{12}_6$, $\mathbf{12}_7$, wherein the same key 2 can be used for at least two locking devices in order to separate the plate tumblers 5A, 5B via their cooperating scanning points such that the cylinder core 4 is rotatable with respect to the cylinder housing 3. However, the key 2 can then no longer be used as a reversible key, since the control ribs 9, 9' of the second are not arranged in a mirror image manner.

With the insertion of the key 2 in a first position, the flanks 8A, 9A are used for scanning the cooperating scanning points of the plate tumblers 5 of the first and of the second type 5A, 5B (two-track locking system).

An insertion of the key 2 in a second position (reversible key position) is not possible due to the non-mirror image arrangement of the control ribs 9, 9'.

The scanning points $\mathbf{12}_1$, $\mathbf{12}_5$ in the scanning planes $\mathbf{11}_1$, $\mathbf{11}_5$ are separately marked, wherein the two-dot dash sequence again indicates that in each scanning plane $\mathbf{11}_n$ depending on the selection of the two types 5A, 5B of plate tumblers 5 can be queried via their cooperating scanning points Third And Fourth Embodiment Third and fourth locking system S3, S4 according to FIGS. 6A through 6E.

The basic structure of the key 2 for the third and fourth locking system $S_3$, $S_4$ is changed, since now a differently embodied and arranged third control track 10 replaces the second control track 9.

For the third and fourth embodiment, plate tumblers 5 of a third type 5C that can be moved in the second radial direction of movement 7.2 are thereby arranged. This third type 5C according to FIG. 6C has as cooperating scanning points opposite tumbler steps 5C-1.

Figure 6A:
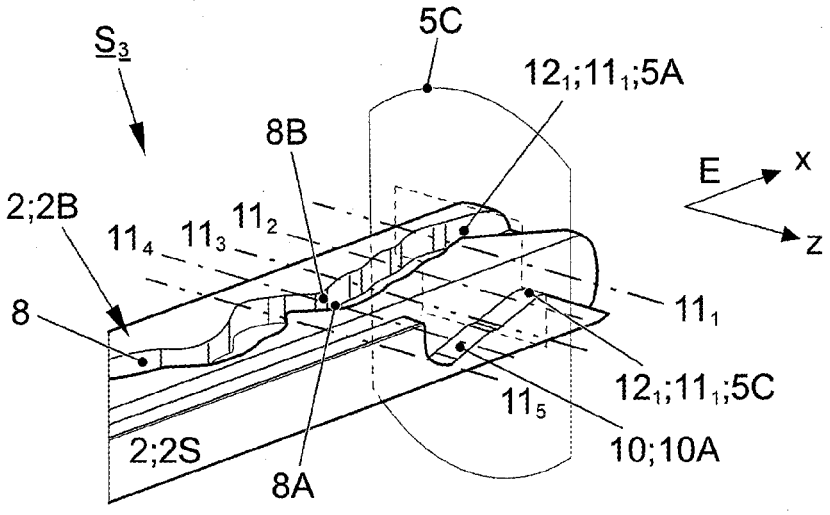
FIGS. 6A, 6B, 6C show a third locking system, in which in every other scanning plane optionally the first or a third type of plate tumbler can be scanned, wherein the key is equipped with a first and a third control track arranged on the key.
Figure 6B:
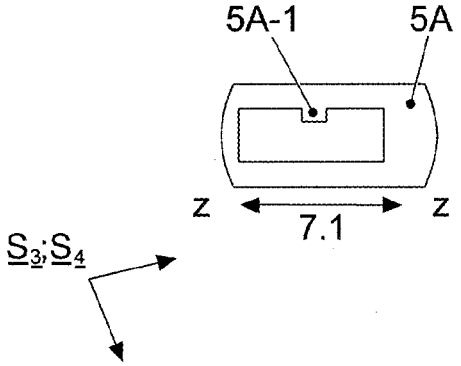

The plate tumbler 5 of the first type 5A is, as FIG. 6B shows, used unchanged in the third and fourth embodiment of the locking system $S_3$, $S_4$.

FIG. 6A shows the difference of this locking system $S_3$, $S_4$ from the two locking systems $S_1$, $S_2$ of the first and second embodiment.

The key 2 of the third and fourth locking system $S_3$, $S_4$ has a third control track 10, the control flank 10A of which is formed on the narrow side 2S of the key 2 and the forced guidance of which is formed by a third on the key 2 now lying on the opposite narrow key side 2S' thereof as a control track 10' in the form of a forced guiding control flank 10A' (not visible in FIG. 6A).

This inevitably results in the changed shape of the plate tumbler 5 of the third type 5C, which is shown according to its intended position with respect to the key 2 in FIG. 6A, wherein the support of one of the two tumbler steps 5C-1 on the forced guiding control flank 10A' is not visible.

Third Embodiment

Figure 6C:
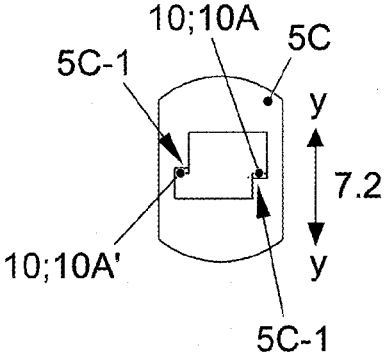

Third locking system $S_3$ according to FIGS. 6A, 6B, 6C in a first embodiment variant.

Analogously to the first locking system $S_1$, the third locking system $S_3$ is characterized in a first embodiment variant, which is shown in FIG. 6A, in that in every other scanning plane $\mathbf{11}_n$ respectively one scanning point $\mathbf{12}_1$, $\mathbf{12}_3$, $\mathbf{12}_5$ (beginning with the first scanning plane $\mathbf{11}_1$)is provided for a plate tumbler 5 of the first type 5A and for a plate tumbler 5 of the third type 5C, whereby in these scanning planes $\mathbf{11}_1$, $\mathbf{11}_3$, $\mathbf{11}_5$ a selection can be made which type 5A or 5C is arranged.

The first scanning plane $\mathbf{11}_1$ of the key 2, for example, has the scanning point $\mathbf{12}_1$ marked in FIG. 6A for a cooperating scanning point for the plate tumbler 5 of the first type 5A as well as of the third type 5C.

The next scanning plane $\mathbf{11}_2$ then however, deviating from the image of FIG. 6A, has only one scanning point $\mathbf{12}_2$ for the plate tumbler of the first type 5A.

This results in the advantage that the third locking system $S_3$ of the first embodiment variant can be composed of at least two key devices, which are characterized by plate tumblers of the first or third type 5A, 5C, which can be variably arranged in at least one scanning plane $\mathbf{11}_n$. The same key 2 can always be used for each of the correspondingly embodied locking devices of the third locking system $S_3$ thereby independently of the arrangement of a plate tumbler 5 of the first or third type 5A, 5C.

The first possibility lies in embodying a locking device such that only plate tumblers 5 of the first type 5A are arranged, the cooperating scanning points of which are queried via the scanning points $\mathbf{12}_1$ through $\mathbf{12}_n$ in each of the scanning planes $\mathbf{11}_1$ through $\mathbf{11}_n$ on the first groove flank 8A of the first control track 8.

Furthermore, the second possibility lies in embodying a locking device in which only plate tumblers of the third type 5C are arranged, the cooperating scanning points of which are queried on the scanning points $12_1$, $12_3$, $12_5$ of the control flank 10A of the third control track 10.

Finally, for a further locking device the third possibility lies in arranging both types of plate tumblers 5 of the first and third type 5A, 5C, wherein it is variably selectable in the scanning planes $11_1$, $11_3$, $11_5$ which of the two plate tumblers 5 of the first type 5A or of the second type 5C are arranged and queried via the cooperating scanning points, wherein in all possible embodiments the same key 2 always can be used for at least two locking devices in order to separate the plate tumblers 5A, 5C such that the cylinder core 4 is rotatable with respect to the cylinder housing 3.

Only the first control track 8 of the first embodiment variant of the third locking system $S_3$ is embodied in a mirror image manner with respect to the first cutting plane $D_{x/z}$, whereby a key 2 with a first and third control track 8, 10, 10' and a first control track 8' arranged lying opposite in a mirror image manner results, whereby depending on the selection of the plate tumblers 5A, 5C in the respective scanning plane $11_n$ a reversible key results only when in the respective scanning plane $11_n$ exclusively plate tumblers 5 of the first type 5A are arranged.

With the insertion of the key 2 in a first position, the flanks 8A, 10A are used for scanning the cooperating scanning points of the plate tumblers 5 of the first and of the third type 5A, 5C (two track locking system).

An insertion of the key 2 in a second position (reversible key position) is not possible due to the non-mirror image arrangement of the control flanks 10A, 10A' of the third control track 10, 10'.

Third Embodiment

Figure 6D:
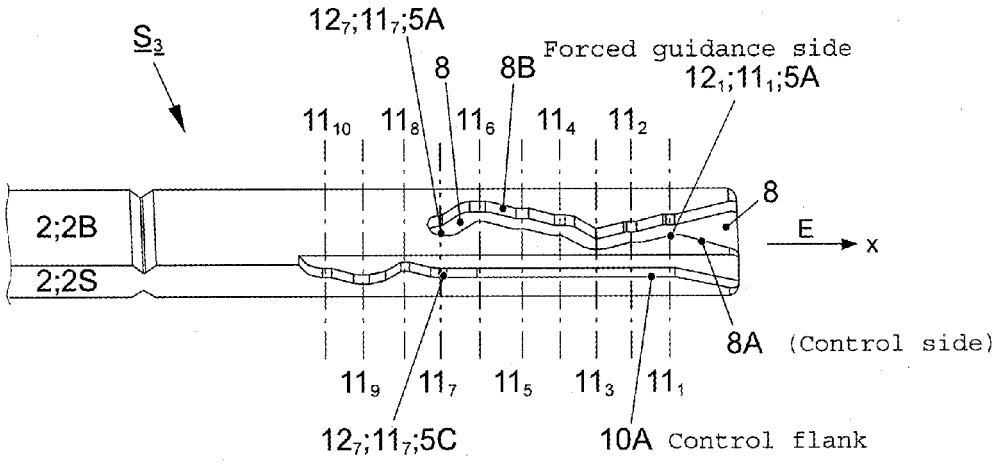
FIGS. 6D, 6E, 6F show the third locking system in which in only one single scanning plane optionally the first or the third type of plate tumbler can be scanned, wherein the key is equipped with the first and third control track arranged on a key.
Figure 6E:
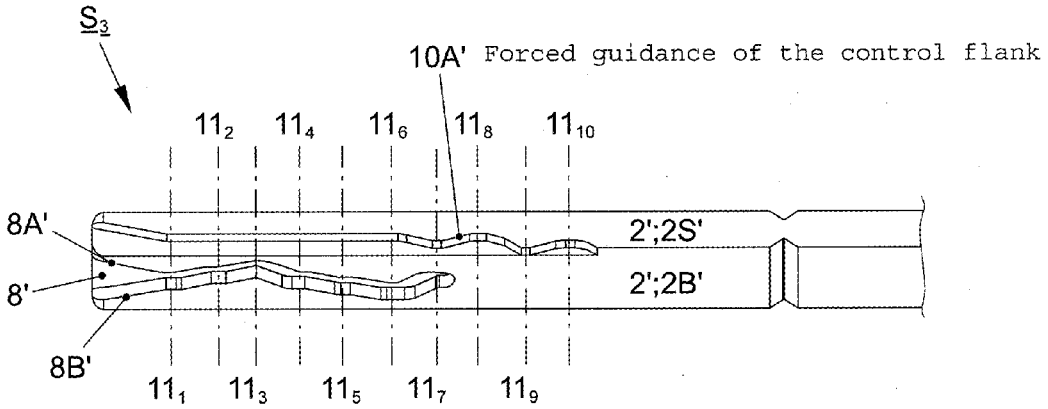
Figure 6F:
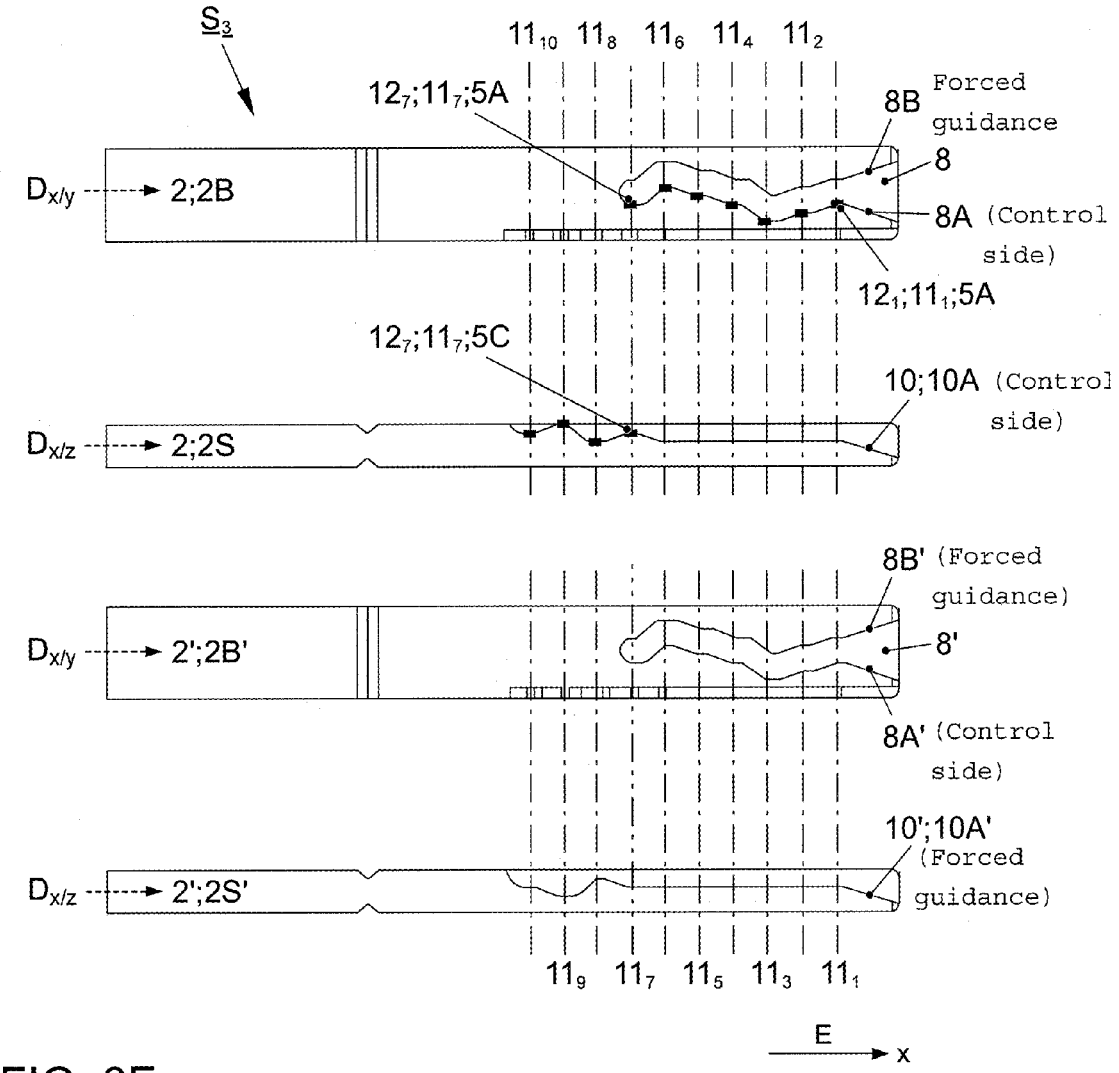

Third locking system $S_3$ according to FIGS. 6D, 6E, 6F in a second embodiment variant.

The third locking system $S_3$ is characterized in a second embodiment variant, which is shown in FIGS. 6D, 6E, 6F, in that only in a single or in the seventh scanning plane $11_7$ respectively one possible scanning point $12_7$ is provided for a variable arrangement of a plate tumbler 5 of the first type 5A or for a plate tumbler 5 of the third type 5C.

The first through sixth scanning plane $11_1$ through $11_6$ of the key 2 according to FIGS. 6D, 6E, 6F as a special feature of this second embodiment variant, for example, has a first to sixth scanning point $12_1$ through $12_6$ for a cooperating scanning point, which are provided exclusively for the plate tumblers 5 of the first type 5A.

The seventh through tenth scanning plane $11_7$ through $11_{10}$ as a special feature of this second embodiment variant has scanning points $12_7$ through $12_{10}$ which are provided exclusively for the cooperating scanning point of the plate tumblers 5 of the third type 5C.

The first control track 8 and the opposite control track 8' is thereby embodied from the start only up to the seventh scanning plane $11_7$ and the third control track 10 or the opposite control track 10' is embodied up to the scanning plane $11_6$ in a simplified manner without contour and thus without coding function.

The scanning points $12_1$ through $12_{10}$, possible in the scanning planes $11_1$ through $11_{10}$, of the second embodiment variant of the third embodiment of a key 2 are again shown by the rectangles in the images of FIG. 6F.

The top diagrammatic image of FIG. 6F shows the wide outer surface 2B of the key 2. Below it the narrow outer surface 2S of the key 2 is shown diagrammatically. Below it the opposite wide outer surface 2B' is shown diagrammatically. And at the very bottom the opposite narrow outer surface 2S' is shown.

As can be seen from the wide outer sides 2B, 2B' lying opposite one another of the top image and the third image from the top shown in the images of FIG. 6F, the first control track 8 and the opposite first control track 8' is embodied in a mirror image manner.

As can be seen from the narrow outer sides 2S, 2S' lying opposite one another of the second image from the top and the fourth image from above shown in FIG. 6F, the control flanks 10A and 10A' are not embodied in a mirror image manner.

Regardless of the described simplified embodiment of the key 2, the advantage in turn results that the third locking system $S_3$ of the second embodiment variant can be composed of at least two key devices, which are characterized by differently arranged plate tumblers 5 of the first type 5A and of the third type 5C.

The same key 2 can be used for each of the correspondingly embodied locking devices.

A first possibility lies in embodying a locking device so that only plate tumblers 5 of the first type 5A are arranged, the cooperating scanning points of which are queried via the scanning points $12_1$ through $12_7$ of the first groove flank 8A of the first control track 8.

Furthermore, a second possibility lies in embodying a locking device in which only plate tumblers 5 of the third type 5C are arranged, the cooperating scanning points of which are scanned on the scanning points $12_7$ through $12_{10}$ of the control flank 10A of the third control track 10, 10A.

Finally, for a further locking device the third possibility again lies in arranging both types of plate tumblers 5A, 5C, wherein in this second embodiment variant of the third locking systems $S_3$ it is variably selectable only in a single scanning plane, the scanning plane $11_7$ which of the two plate tumblers of the first type 5A or of the third type 5C is arranged and queried via its respective cooperating scanning point, wherein in all possible embodiments the same key 2 can always be used for at least two locking directions in order to separate the plate tumblers 5A, 5C such that the cylinder core 4 can be rotated with respect to the cylinder housing 3.

Only the first control track 8 of the second embodiment variant of the third locking system $S_3$ is arranged in a mirror image manner on an opposite side of the key 2 with respect to the first cutting plane $D_{x/Z}$, whereby a key 2 with a first control track 8 and a first control track 8' lying opposite arranged in a mirror image manner results, whereby depending on the selection of the plate tumblers 5A, 5C in the respective scanning plane $11_n$ a reversible key results only when exclusively plate tumblers 5 of the first type 5A are arranged in the respective scanning plane $11_n$.

One example: For a vehicle with a keyless entry system or a keyless go system, a key bit is necessary only to lock the glove box and as emergency key for opening the driver's door in an emergency. For example, two locking devices with a key bit of the third locking system $S_3$ of the second embodiment variant should be used.

For the glove box, for example, a lock cylinder 3, 3A, 4 or 3, 3A, 4 with a free-turning sleeve 4A is used, the plate tumblers 5 of which are exclusively first plate tumblers 5A which are scanned by the key bit in the scanning planes $11_1$ through $11_7$.

Naturally, a higher or lower number of plate tumblers of the first type 5A can be arranged, since the number of seven plate tumblers 5 is only by way of example. If only plate tumblers 5 of the first type 5A are arranged in the locking cylinder, the key bit as described can be inserted into the key channel 6 of the locking device 1 without attention to the sides, since the key bit of the key 2 is a reversible key due to the mirror image arrangement of the first control track 8 and of the opposite first control track 8' for the locking device 1 of the glove box as described.

However, a reversible key does not necessarily have to be used for the emergency key on the driver's door, whereby the key 2 can be produced more cost-effectively due to the simplified embodiment of the control tracks 8, 10 in particular of the third control track 10. For the lock cylinder 3, 3A, 4 or 3, 3A, 4, 4A of an emergency locking device by way of example plate tumblers of the first type 5A and of the third type 5C are arranged, which scan the key bit for example in the scanning planes $\mathbf{11}_1$ through $\mathbf{11}_{10}$. Through the use of a plate tumbler 5 of the third type 5C, however, the key 2 can no longer be used as a reversible key, since the third control track 10 and the opposite control track 10' in the exemplary embodiment are not embodied in a mirror image manner respect to the second cutting plane $D_{x/y}$.

The third locking system $S_3$, like all other locking systems in the at least one scanning plane (here the scanning plane $\mathbf{11}_7$) of a provided scanning point (here the scanning point $\mathbf{12}_7$) is variable such that both types of plate tumblers 5A and 5C can be scanned and separated via their cooperating scanning points so that the arrangement of one type of the two plate tumblers 5A, 5C in at least this one scanning plane $\mathbf{11}_7$ can be freely selected, whereby the variability of the arrangement of plate tumblers 5 of at least two locking devices (glove box locking device and emergency locking device on a driver's door or a trunk) with cylinder cores, with associated cylinder housings, adapted to the plate tumblers 5A 5C is increased.

In the scanning planes $\mathbf{11}_1$ through $\mathbf{11}_6$ for example, scanning is carried out via the first plate tumblers 5A at the scanning points $\mathbf{12}_1$ through $\mathbf{12}_6$ of the first groove flank 8A. Subsequently, scanning is carried out in the scanning planes $\mathbf{11}_7$ through $\mathbf{11}_{10}$ via the third plate tumblers 5C at the scanning points $\mathbf{12}_7$ through $\mathbf{12}_{10}$ of the control flank 10A.

Naturally, a higher or lower number of plate tumblers 5 of the first type 5A or of the second type 5C can be arranged, since the number of six plate tumblers of the first type 5A and of four plate tumblers 5C of the third type 5C is only by way of example.

However, the key bit can be inserted into the key channel 6 of the locking device 1 only such that the control flank 10, 10A presses away the plate tumblers of the third type in the scanning planes $\mathbf{11}_7$ through $\mathbf{11}_{10}$ on the scanning points $\mathbf{12}_7$ through $\mathbf{12}_{10}$, whereby the cylinder core 4 can be rotated with respect to the cylinder housing.

If the key 2 is inserted the other way around, the forced guidance track 10A' of the third control track 10', since it is not arranged in a mirror image manner with respect to the second cutting plane $D_{x/y}$, will not press away or scan the plate tumblers 5C.

The presented key 2 of the third locking system $S_3$ in the second embodiment variant, due to the embodiment of the opposite control flanks 10A, 10A', not arranged in a mirror image manner, of the third control track 10 or the opposite third control track 10', as mentioned above, with the plate tumblers 5 of the third type 5C, does not form a reversible key.

This means that with the insertion of the key 2 in a first position the flanks 8A, 10A are used for scanning the cooperating scanning points of the plate tumblers 5 of the first and of the third type 5A, 5C (two-track locking system).

An insertion of the key 2 in a second position (reversible key position) is not possible due to the non-mirror image arrangement of the control flanks 10A, 10A' of the third control track 10, 10'.

Fourth Embodiment

Figure 6H:
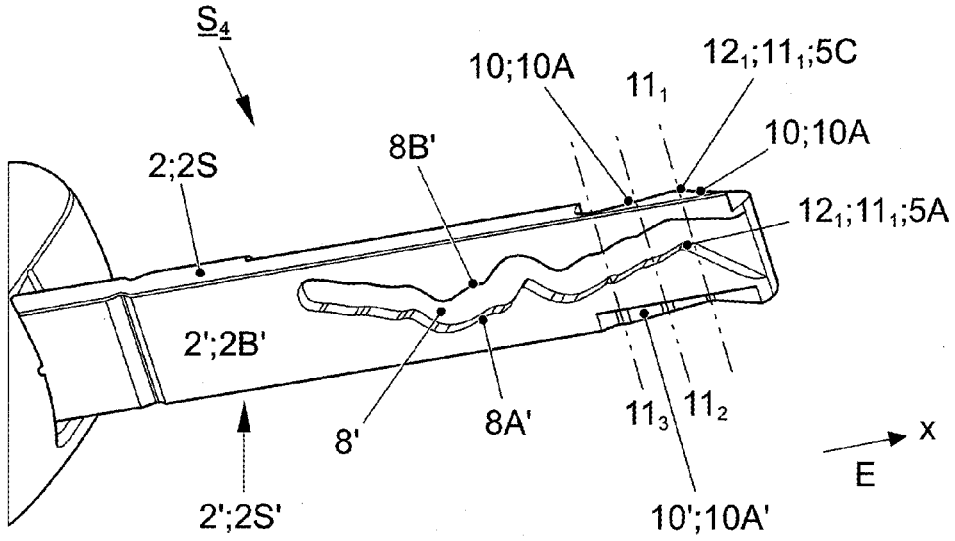
FIGS. 6H, 6I show a fourth locking system in which in each scanning plane optionally the first or the third type of plate tumbler can be scanned, wherein the key is equipped with the first and third control track arranged on a key.
Figure 6I:
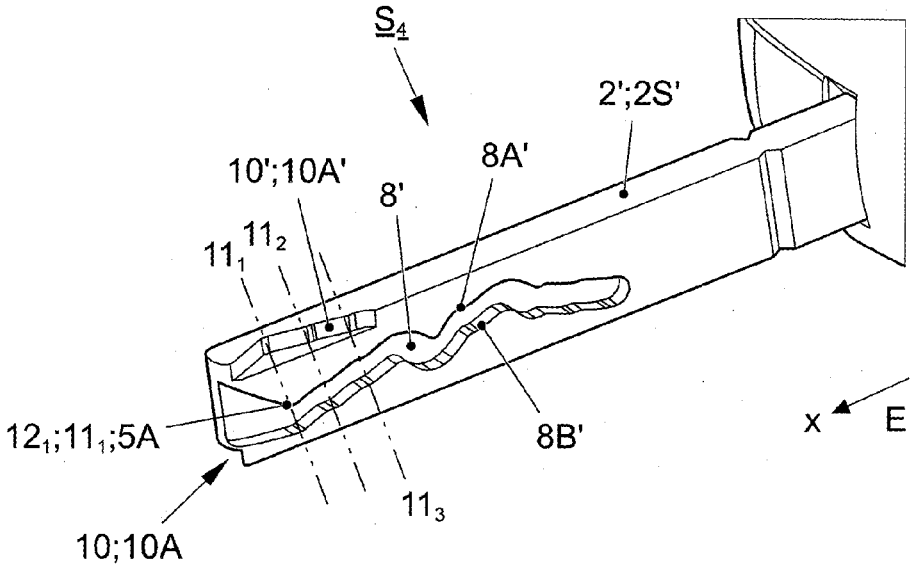

Fourth locking system $S_4$ according to FIGS. 6H and 6I.

Analogously to the third locking system $S_3$, the fourth locking system $S_4$ is characterized in that according to FIGS. 6H, 6I in each scanning plane $\mathbf{11}_n$ of the key 2 respectively one scanning point $\mathbf{12}_1$, $\mathbf{12}_2$, $\mathbf{12}_3$ for the cooperating scanning point of a plate tumbler 5 of the first type 5A and for the cooperating scanning point of a plate tumbler 5 of the third type 5C is provided. In the further scanning planes $\mathbf{11}_4$, $\mathbf{11}_5$, $\mathbf{11}_6$, $\mathbf{11}_7$, $\mathbf{11}_8$, $\mathbf{11}_9$, $\mathbf{11}_{10}$ only plate tumblers 5 of type 5A can be arranged.

The first scanning plane $\mathbf{11}_1$ thus has a scanning point $\mathbf{12}_1$ marked in FIGS. 6H and 6I for the cooperating scanning points of the plate tumbler 5 of the type 5A or plate tumblers 5 of the type 5C. The user can select the arrangement of the plate tumblers 5A or 5C.

In the exemplary embodiment of FIGS. 6H and 6I in a special feature of this locking system $S_4$ only the first three scanning planes $\mathbf{11}_1$, $\mathbf{11}_2$, $\mathbf{11}_3$ are embodied for the two types of plate tumblers 5 of the first type 5A and of the third type 5C. This embodiment can be expanded to any desired further number of scanning points $\mathbf{12}_n$ in the scanning planes $\mathbf{11}_4$, $\mathbf{11}_5$, $\mathbf{11}_6$, $\mathbf{11}_7$, $\mathbf{11}_8$, $\mathbf{11}_9$, $\mathbf{11}_{10}$. The variability of the arrangement of plate tumblers 5 of type 5A or 5C increases accordingly.

The possible arrangement of the different types 5A or 5C of the plate tumblers 5 corresponds to the different embodiment variants that have already been described for the third embodiment. A reversible key, following the logic of the third locking system $S_3$, can be embodied only when only plate tumblers 5 of the type 5A are arranged, since the third control track 10 and the opposite third control track 10' is not arranged in a mirror image manner with respect to the second cutting plane $D_{x/y}$.

This means that with the insertion of the key 2 in a first position, the flanks 8A, 10A are used for scanning the cooperating scanning points of the plate tumblers 5 of the first or of the third type 5A, 5C (two-track locking system).

An insertion of the key 2 in a second position (reversible key position) is not possible due to the non-mirror image arrangement of the control flanks 10A, 10A' of the third control track 10, 10'.

Fifth Embodiment

Fifth locking system $S_5$ according to FIGS. 7A through 7F.

FIGS. 7A through 7F clarify the difference of the fifth locking system S5 compared to the locking systems $S_1$, $S_2$, $S_3$, $S_4$ previously described.

The key 2 of the fifth locking system $S_5$ has the third control track 10 already used in the third and fourth locking system $S_3$, $S_4$. The control flank 10A thereof is formed as before on the narrow side 2S of the key 2 and as before by the third forced guiding control flank 10A' on the opposite narrow key side 2S' of the key 2' of the opposite control track 10'.

However, deviating from the previous locking systems $S_1$ through $S_4$, the key 2 is provided with a fourth control track 14, 14' which now is arranged jointly with the third control track 10, 10', The fourth control track 10 used likewise has a control flank 14A on the fourth control track 14 of the wide side 2B of the key 2, wherein the force guidance thereof by a fourth on the key 2 now is formed on the opposite wide key side 2B' thereof as forced guiding control flank 14A' of the opposite fourth control track 14'.

This again inevitably results in a changed shape for the plate tumblers 5 responsible for the fourth control track 14 or the opposite fourth control track 14', as explained below.

Figure 7A:
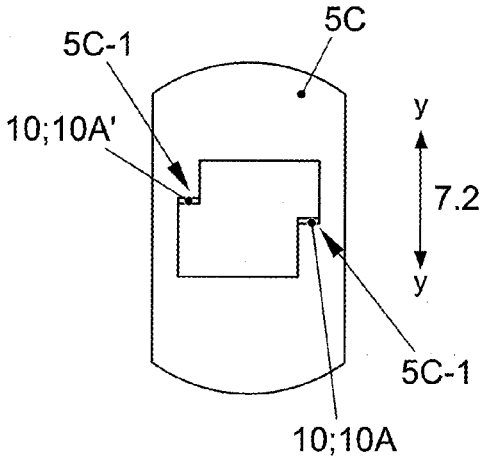
FIGS. 7A through 7F show a fifth locking system, in which in each scanning plane optionally the third or a fourth type of plate tumbler can be scanned, wherein the key is equipped with the third and a fourth control track arranged on a key.

In the fifth locking system $S_5$ in the cylinder core 4, as shown by FIG. 7A in conjunction with FIGS. 2A, 2B and FIG. 3, as before plate tumblers that can be moved in the second radial direction of movement 7.2, of the third type 5C are arranged, which are queried by the third control track 10, 10' of the key 2. This third type 5C of the plate tumblers 5 according to FIG. 7A analogously to FIG. 6C as cooperating scanning points to the scanning points of the key 2 has tumbler steps 5C-1 arranged on both sides.

Figure 7B:
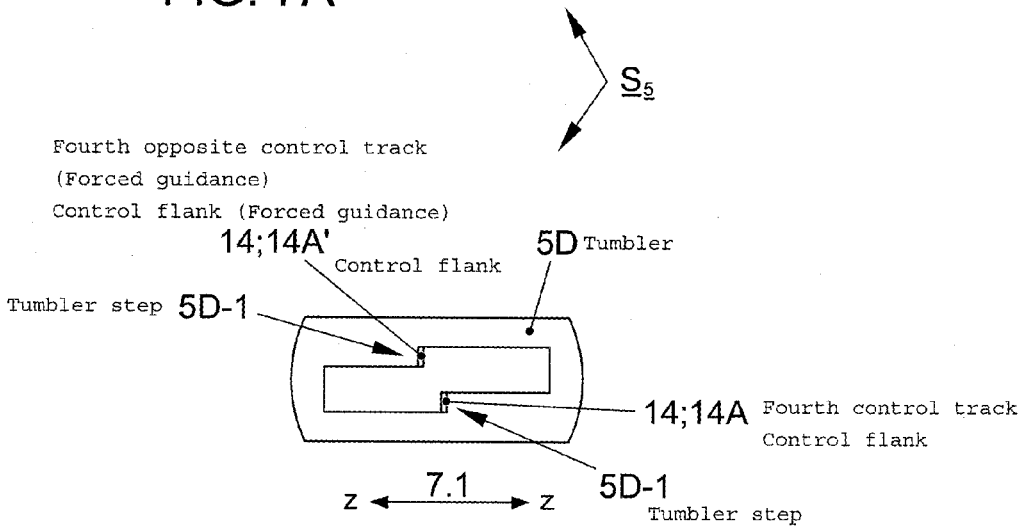

In the fifth locking system $S_5$ furthermore in the cylinder core 4, as FIG. 7B shows in connection with FIGS. 2A, 2B and FIG. 3, plate tumblers 5 moveable in the first radial direction of movement 7.1 are arranged. Now plate tumblers 5 of a fourth type 5D are arranged, which are queried by the fourth control track 14 or the opposite control track 14' of the key 2.

This type 5D analogously to FIG. 7A has as cooperating scanning points likewise tumbler steps 5D-1 arranged on both sides. This fourth type 5D of the plate tumblers 5 is thus embodied in a manner coordinated with the shape of the fourth control track 14, 14' of the key 2.

Due to the described embodiment of the key 2, in this fifth locking system $S_5$ the advantage also results that the system $S_5$ can be composed of at least two key devices which are characterized by different arranged variably selectable plate tumblers 5 in a scanning plane $\mathbf{11}_n$, either of the third type 5C or of the fourth type 5D. The same key 2 can be used for each of the correspondingly embodied at least two locking devices.

As FIGS. 7A through 7F clarify by the two-dot dash sequence, a first possibility is embodying a locking device in which in all scanning planes $\mathbf{11}_1$ through $\mathbf{11}_7$ only plate tumblers 5 of the third type 5C are arranged, the cooperating scanning points of which are queried via the scanning points $\mathbf{12}_1$ through $\mathbf{12}_7$ of the control flank 10A of the third control track 10.

Furthermore, the second possibility lies in embodying a locking device in which in all of the scanning planes $\mathbf{11}_1$ through $\mathbf{11}_7$ only plate tumblers 5 of the fourth type 5D are arranged, the cooperating scanning points of which are scanned at the scanning points $\mathbf{12}_1$ through $\mathbf{12}_7$ of the control flank 14A of the fourth control track 14, 14A.

Finally, for a further locking device the third possibility lies in arranging both types of plate tumblers 5C, 5D wherein in this fifth locking system $S_5$ in all scanning planes $\mathbf{11}_1$ through $\mathbf{11}_7$ it can be variably selected which of the two plate tumblers of the third type 5C or of the fourth type 5D with their cooperating scanning points are arranged, which are queried by the scanning points $\mathbf{12}_1$-$\mathbf{12}_7$ of the key 2, wherein in all possible embodiments the same key 2 can always be used for at least two locking devices, in order to separate the plate tumblers 5 of the third type 5C and of the fourth type 5D such that the cylinder core 4 is rotatable with respect to the cylinder housing 3.

Some of the scanning points $\mathbf{12}_1$, $\mathbf{12}_3$, $\mathbf{12}_4$, $\mathbf{12}_6$ in the scanning planes $\mathbf{11}_1$, $\mathbf{11}_3$, $\mathbf{11}_4$, $\mathbf{11}_6$ are separately labeled wherein the respective two-dot dash sequence in these scanning planes $\mathbf{11}_1$, $\mathbf{11}_3$, $\mathbf{11}_4$, $\mathbf{11}_6$ and also in the other scanning planes $\mathbf{11}_2$, $\mathbf{12}_5$, $\mathbf{12}_7$ indicates that the scanning points $\mathbf{12}_1$, $\mathbf{12}_3$, $\mathbf{12}_4$, $\mathbf{12}_6$ of the key in each scanning plane $\mathbf{11}_n$ queries the cooperating scanning points of a plate tumbler 5 of the third type 5C or of the fourth type 5D.

Figure 7C:
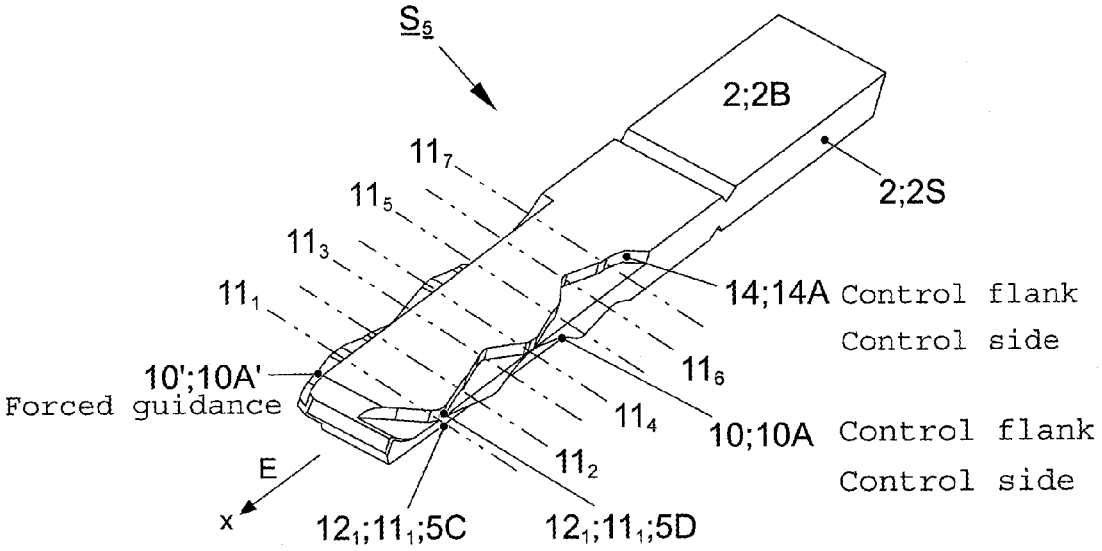

FIG. 7C shows the possible scanning points $\mathbf{12}_1$ in the scanning plane $\mathbf{11}_1$. The two-dot dash sequence in this scanning plane $\mathbf{11}_1$ indicates that in this embodiment variant the cooperating scanning point of the scanning point $\mathbf{12}_1$ of this scanning plane $\mathbf{11}_1$ of the plate tumblers 5 of the third type 5C or of the fourth type 5D can be queried on the control flank 10A of the third control track 10 or on the control flank 14A of the fourth control track 14.

The respectively opposite control flank 10A' of the third opposite control track 10' or the opposite control flank 14A' of the fourth opposite control track 14' is again thereby used as a forced guidance for that tumbler step 5D-1 of the plate tumblers of the third type 5C or of the fourth type 5D that are pressed by the spring element 3A, not shown in further detail, not at the respective scanning point $\mathbf{12}_n$.

Figure 7D:
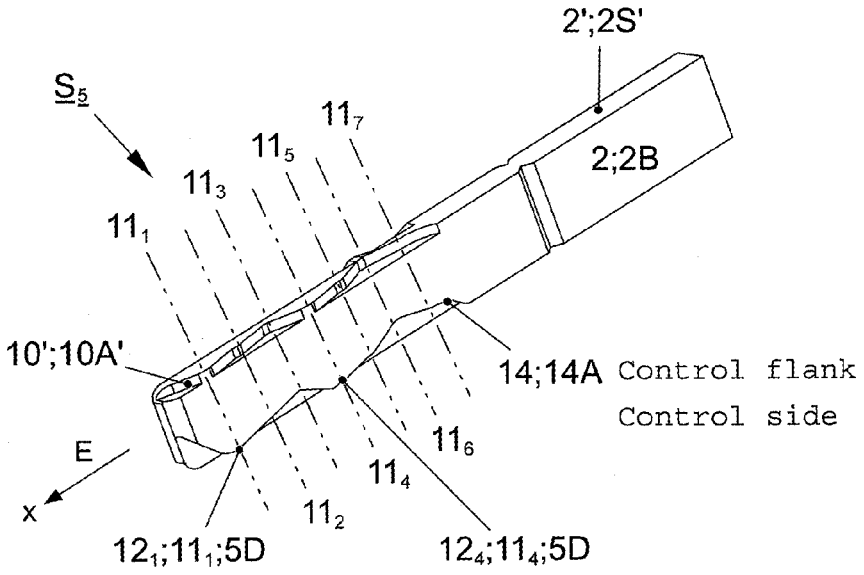

FIG. 7D refers by way of example to the possible scanning points $\mathbf{12}_1$, $\mathbf{12}_4$ of the key 2 in the scanning plane $\mathbf{11}_1$ and $\mathbf{11}_4$. The two-dot dash sequence in the scanning planes $\mathbf{11}_n$ indicates again in FIGS. 7A through 7F that in this embodiment variant the cooperating scanning points in these scanning planes $\mathbf{11}_1$ and $\mathbf{11}_4$ both types of plate tumblers 5 of the third type 5C and of the fourth type 5D can be queried on the control flank 10A of the third control track 10 or on the control flank 14A of the fourth control track 14.

However, in FIG. 7D the control flank 10, 10A of the third control track 10 is not visible so that in FIG. 7D by way of example only the scanning points $\mathbf{12}_1$ and $\mathbf{12}_4$ are indicated in the scanning planes $\mathbf{11}_1$ and $\mathbf{11}_4$ which are queried via the cooperating scanning points of the plate tumblers 5 of the fourth type 5D.

Figure 7E:
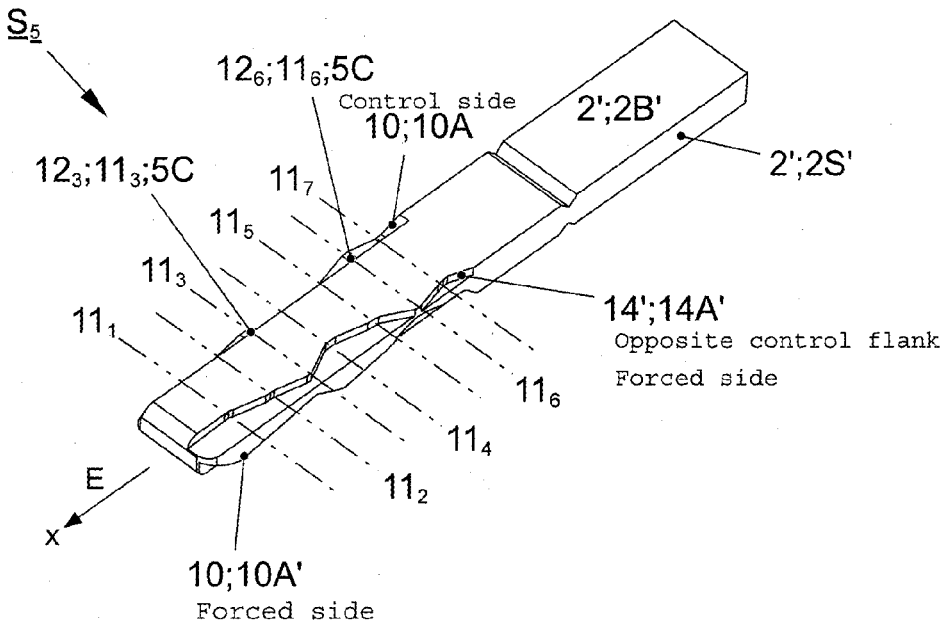

In contrast thereto, in FIG. 7E reference is made by way of example only to the scanning points $\mathbf{12}_3$ and $\mathbf{12}_6$ in the scanning planes $\mathbf{11}_3$ and $\mathbf{11}_6$, which query the cooperating scanning points of the plate tumblers 5 of the third type 5C.

In FIG. 7E the control flank 14A of the fourth control track 14 is not visible, since it lies on the rear side of the key 2, so that the possible scanning points of the control flank 14A of the fourth control track 14, which can query the cooperating scanning points of the plate tumblers 5 of the fourth type 5D, cannot be marked with reference numbers.

Figure 7F:
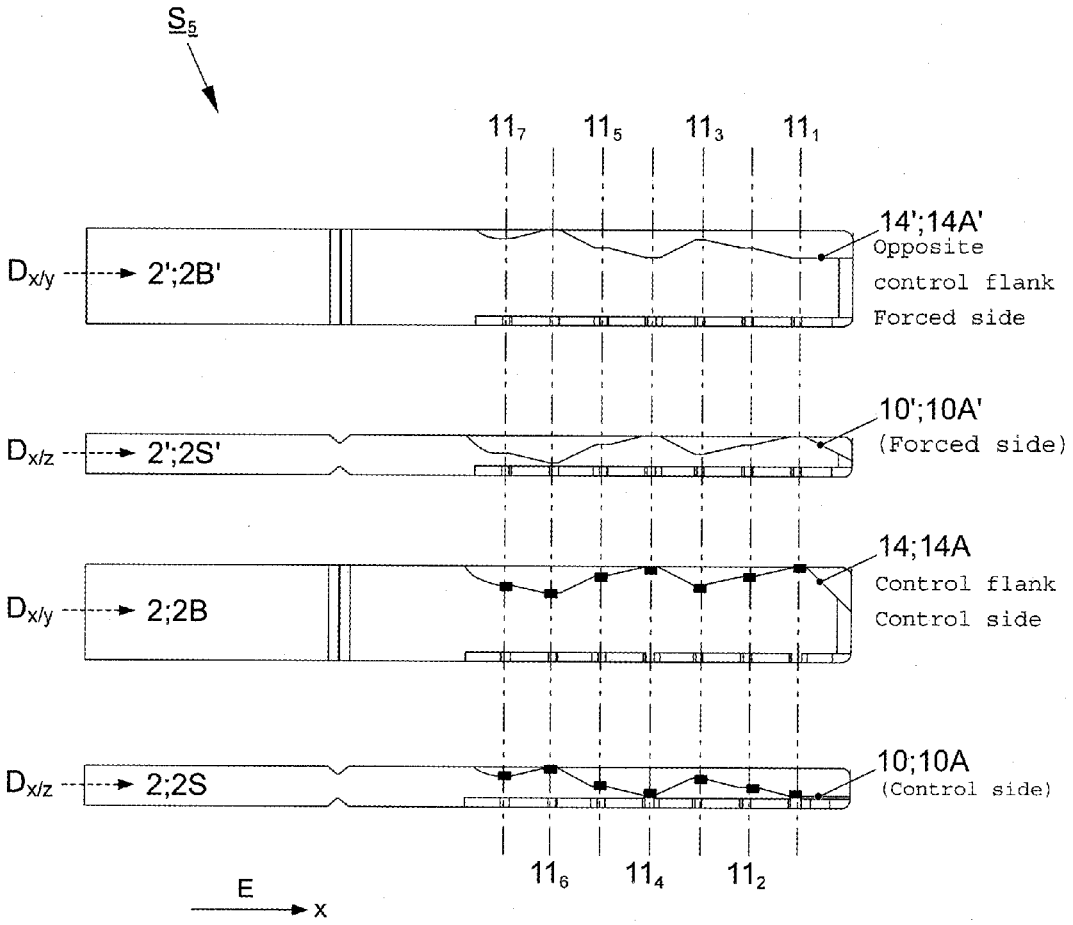

FIG. 7F in turn shows four diagrammatic images of the key 2 from the top down.

The possible scanning points $\mathbf{12}_1$ through $\mathbf{12}_7$ in the scanning planes $\mathbf{11}_1$ through $\mathbf{11}_7$ of the key 2 of the fifth locking system $S_5$, which scan and separate the cooperating scanning points of the plate tumblers 5 of the third or fourth type 5C, 5D, are in turn shown by the rectangles in the images of FIG. 7F.

It is discernible that the control flanks 14A, 10A of the fourth or third control track 14, 10 in all of the scanning planes $\mathbf{11}_1$ through $\mathbf{11}_7$ shown by way of example have the possible variably usable scanning points $\mathbf{12}_1$ through $\mathbf{12}_7$ of the key 2 for the variably selectable plate tumblers of the third or fourth type 5C, 5D.

The opposite control flanks 14A' and 10A' of the fourth or third opposite control track 14', 10' (top image and the image below) in this embodiment are the forced guiding control flanks 14A' 10A' for the plate tumblers 5 of the third or fourth type 5C, 5D.

The third diagrammatic image from the top shows the wide outer surface 2B of the key 2. Below it the narrow outer surface 2S of the key 2 is shown diagrammatically. At the top the opposite wide key side 2B' is shown diagrammatically. Below it in the second position the opposite narrow key side 2S' is shown.

As can now be seen by the wide outer sides 2B', 2B lying opposite one another of the upper image and the third image from the top shown in FIG. 7F, the control flank 14A' of the fourth opposite control track 14' and the control flank 14A of the fourth control track 14 is not embodied in a mirror image manner with respect to the first cutting plane $D_{x/z}$ of the key 2.

As can be further seen from the narrow outer sides 2S', 2S lying opposite one another, shown in FIG. 7F, of the second image from the top and the fourth image from the top, the control flank 10A' of the third opposite control track 10' and the control flank 10A of the third control track 10 are not embodied in a mirror image manner either with respect to the second cutting plane $D_{x/y}$ of the key 2.

The key 2 thereby cannot be used as a reversible key, since the opposite control flanks 10A, 10A' of the third control track 10, 10' and the control flanks 14A, 14A' lying opposite one another of the fourth control track 14, 14' on the key 2 of the fifth locking system $S_5$ are not arranged in a mirror image manner.

This in turn means that with the insertion of the key 2 in a first position the flanks 10A, 14A are used for scanning the cooperating scanning points of the plate tumblers 5 of the third or of the fourth type 5C, 5D (two-track locking system).

An insertion of the key 2 in a second position (reversible key position) is not possible due to the non-mirror image arrangement of the control flanks 10A', 14A' of the third control track and fourth control track 10', 14'.

Due to the arrangement of different plate tumblers 5A, 5B or 5A, 5C or 5C, 5D in the consecutive scanning planes $\mathbf{11}_n$ in the insertion direction of the key 2 or of the reversible key 2 of the locking devices of a locking system $S_n$, in particular a door lock cylinder or an ignition and steering lock cylinder or a lock cylinder for a glove box, with a break in carried out mechanically in one of the locking devices several different tools are needed in order to move the plate tumblers out of the blocking recesses of the cylinder housing. The sequence of the arranged plate tumblers of identical or different types of plate tumblers in the insertion direction can thereby be selected such that identical types or different types of plate tumblers are arranged in consecutive scanning planes.

The number of possible sequences of plate tumblers is increased compared to the prior art wherein in particular when different types of plate tumblers are arranged in a locking device, the variability of the arrangement and thus the multiplicity of the possible sequences of plate tumblers compared to the prior art is increased considerably, since according to the invention in at least one scanning plane with one key different types of plate tumblers are coded, that is, can be queried via their cooperating scanning points of scanning points arranged on the key or reversible key for both types of plate tumblers.

The variability of the coding and thus the safety with respect to being forced open of the locking devices of the locking systems can be further increased, as is explained in greater detail below.

Force direction of the spring-loaded plate tumblers:

Firstly, it is explicitly pointed out once again that the four types of plate tumblers 5A, 5B, 5C, 5D can always be moved with respect to the axial cylinder axis 7 of the cylinder core 4 in a spring-loaded manner by an arranged spring element 3A always in both directions of the first radial direction of movement 7.1 or the second radial direction of movement 7.2.

This possibility is clarified by the double arrows in FIG. 2B, which show that the plate tumblers 5A, 5B from the prior art can already be moved in a spring-loaded manner in both directions of the radial directions of movement 7.1 and 7.2.

This applies in this respect also to the new plate tumblers 5 of the third and fourth type 5C, 5D, which are not described in the prior art.

In the preceding examples, for the sake of clarity the types of plate tumblers 5A, 5B, 5C, 5D were always loaded in the same direction of the first or second radial directions of movement 7.1 and 7.2.

A spring element 3A assigned to each plate tumbler 5 engages on a projection 5-1 not shown in the described figures according to the invention of the five embodiments (but is shown in FIG. 3). Due to the arrangement of the projection 5-1 and the establishment of the force direction of the spring element 3A it can be ensured that a plate tumbler 5 can be moved in a spring-loaded manner in the one or other direction of the radial directions of movement 7.1 and 7.2.

Arrangement of the plate tumblers:

Secondly, it is explicitly pointed out once again that the four types of plate tumblers 5A, 5B, 5C, 5D, as shown in FIG. 2B, in the longitudinal direction of the key 2 in the scanning planes $\mathbf{11}_n$ can always be arranged in the same position or rotated by 180° with respect to their longitudinal axis.

In the preceding examples for the sake of clarity the types of plate tumblers 5A, 5B, 5C, 5D with respect to the key 2 were always arranged in the same position, so that the respective type 5A, 5B, 5C, 5D are arranged seen in the longitudinal direction of the key channel 6 (as is visible in FIGS. 2A, 2B).

An exception is the third embodiment variant of the first embodiment (see FIGS. 4E and 4F).

In this embodiment variant the plate tumblers 5 of the second type 5B were arranged offset by 180° in every other scanning plane $\mathbf{11}_1$ through $\mathbf{11}_{10}$, so that the tumbler groove 5B-1 can query once the cooperating scanning points of the first rib flank 9A in the scanning planes $\mathbf{11}_1$, $\mathbf{11}_3$, $\mathbf{11}_5$, $\mathbf{11}_7$, $\mathbf{11}_9$ with the scanning points $\mathbf{12}_1$, $\mathbf{12}_3$, $\mathbf{12}_5$, $\mathbf{12}_7$, $\mathbf{12}_9$ and another time the cooperating scanning points of the first opposite rib flank 9A' in the scanning planes $\mathbf{11}_2$, $\mathbf{11}_4$, $\mathbf{11}_6$, $\mathbf{11}_8$, $\mathbf{11}_{10}$ in the scanning points $\mathbf{12}_2$, $\mathbf{12}_4$, $\mathbf{12}_6$, $\mathbf{12}_8$, $\mathbf{12}_{10}$.

In this exemplary embodiment it is already shown that depending on the arrangement of the plate tumblers 5 more than two flanks of a key 2 can be added for scanning the cooperating scanning points due to the respective plate tumblers 5 of a locking device.

Due to the changed arrangement coordinated with the key 2 of the plate tumblers 5 and the selection of the force direction of the spring elements 3A, thus multiple-track systems going beyond two-track locking systems can be formed.

Figure 8A:
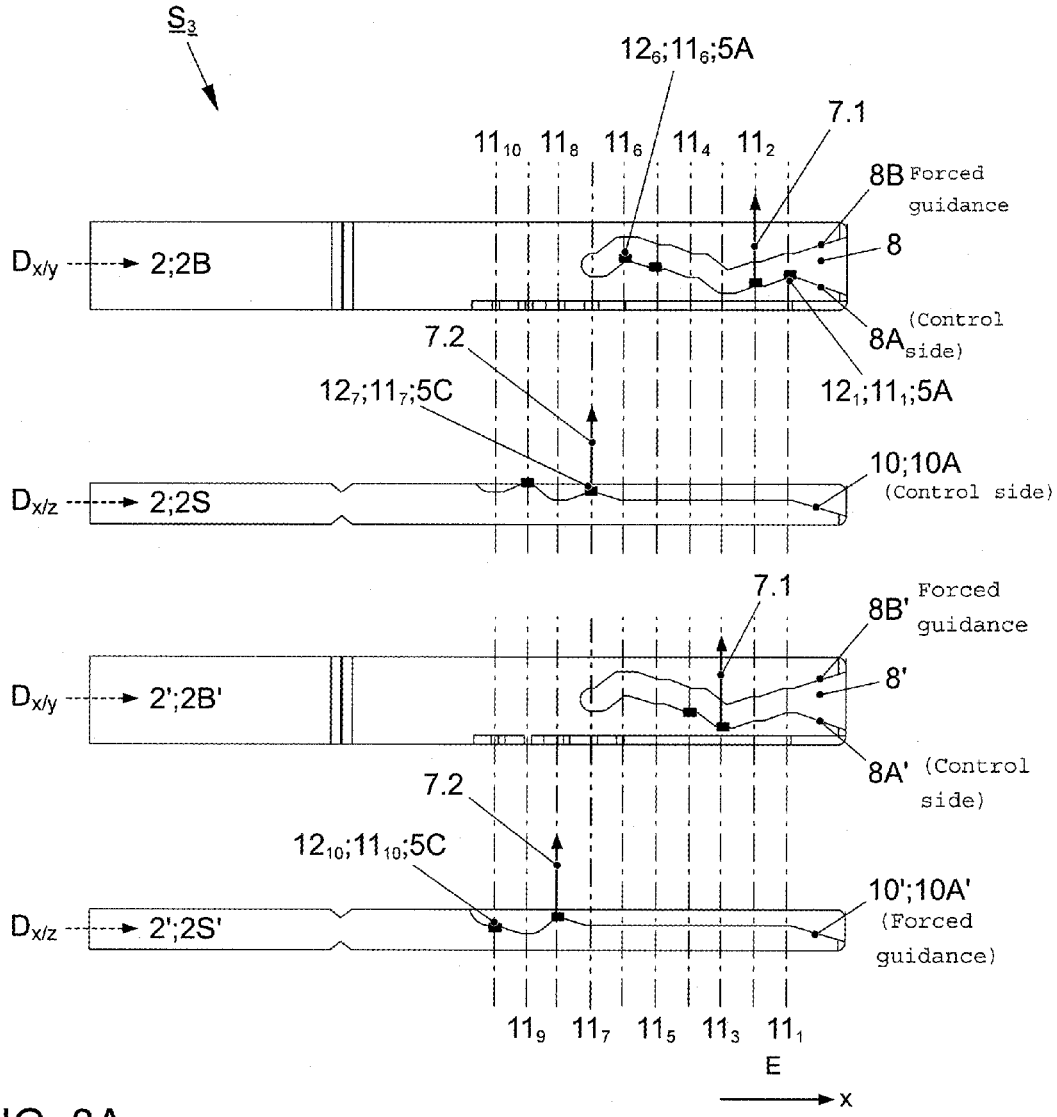
FIGS. 8A and 8B show based on the third locking system, starting from FIG. 6F by way of example a four-track and a six-track locking system.

One example: a four-track locking system is shown by FIG. 8A based on FIGS. 6D, 6E, 6F.

The top two images of FIG. 6F show that the control flank 8A and 10A are used for query of the cooperating scanning points of the plate tumblers 5 of the first type 5A and of the third type 5C.

The rectangles of FIG. 8A show the scanning points $\mathbf{12}_n$, with which the cooperating scanning points of the plate tumblers 5 of the first and of the third type 5A, 5C can be scanned by the selectable radial action direction 7.1 and 7.2 of the spring elements 3A and by an arrangement pivoted by 180° around the longitudinal axis of the plate tumblers 5A, 5C.

The arrows 7.1 and 7.2 show the direction of action that the scanning points $\mathbf{12}_n$ of the key 2 exert opposite to the respective spring element 3A on the plate tumblers 5 of the first or of the third type 5A, 5C.

The plate tumblers 5 of the first type 5A according to FIG. 8A, top image, which shows the wide outer side 2B of the key 2, are scanned, that is, pressed away by means of the first groove flank 8A in the scanning planes $\mathbf{11}_1$, $\mathbf{11}_2$, $\mathbf{11}_5$, $\mathbf{11}_6$ in a direction of the radial direction of movement 7.1. The plate tumblers 5 of the first type 5A engage with their tumbler noses 5A-1 on the first groove flank 8A of the first control track 8.

The plate tumblers 5 of the first type 5A according to FIG. 8A, third image from the top, which shows the opposite wide outer side 2B' of the key 2, are scanned, that is, pressed away by means of the first opposite groove flank 8A' in the scanning planes $\mathbf{11}_3$, $\mathbf{11}_4$ in the opposite direction of the radial direction of movement 7.1. The plate tumblers 5 of the first type 5A engage with their tumbler noses 5A-1 on the first opposite groove flank 8A' of the opposite the first control track 8'.

The plate tumblers 5 of the third type 5C according to FIG. 8A, second image from the top, which shows the narrow outer side 2S of the key 2, are scanned, that is, pressed away by means of the control flank 10A in the scanning planes $\mathbf{11}_7$, $\mathbf{11}_9$ in a direction of the radial direction of movement 7.2. The plate tumblers 5 of the third type 5C engage with their tumbler steps 5C-1 on the first control flank 10A of the third control track 8.

The plate tumblers 5 of the third type 5C according to FIG. 8A, bottom image, which shows the opposite narrow outer side 2S of the key 2, are scanned, that is, pressed away by means of the opposite control flank 10A' in the scanning planes $\mathbf{11}_8$, $\mathbf{11}_{10}$ in an opposite direction of the radial direction of movement 7.2. The plate tumblers 5 of the third type 5C engage with their tumbler steps 5C-1 on the first opposite control flank 10A' of the third opposite control track 8.

Thus four flanks, the flanks 8A, 8A', 10, 10A' are used for scanning the cooperating scanning points of the plate tumblers 5 of the first and third type 5A, 5C.

Within the meaning of the invention, in FIG. 8A in the seventh scanning plane $\mathbf{11}_7$ one scanning point $\mathbf{12}_7$ of the key 2 is again shown by a two-dot dash sequence, in which it is variably selectable whether a cooperating scanning point of a plate tumbler of the first type 5A or a cooperating scanning point of the plate tumbler of the third type 5C should be queried.

In the example shown, in the scanning points $\mathbf{12}_2$, $\mathbf{11}_7$ plate tumblers 5 of the third type 5C are selected. It would also be possible according to the invention in the scanning point $\mathbf{12}_2$, $\mathbf{11}_7$ to arrange a plate tumbler 5 of the type 5A in the locking cylinder 3, 4 or 3, 4A without changes having to be made to the key 7.

A further example: A six-track locking system is shown by FIG. 8B based on FIGS. 6D, 6E, 6F.

The top two images of FIG. 6F show that the control flank 8A and 10A are used for the query of the cooperating scanning points of the plate tumblers 5 of the first type 5A and of the third type 5C.

Figure 8B:
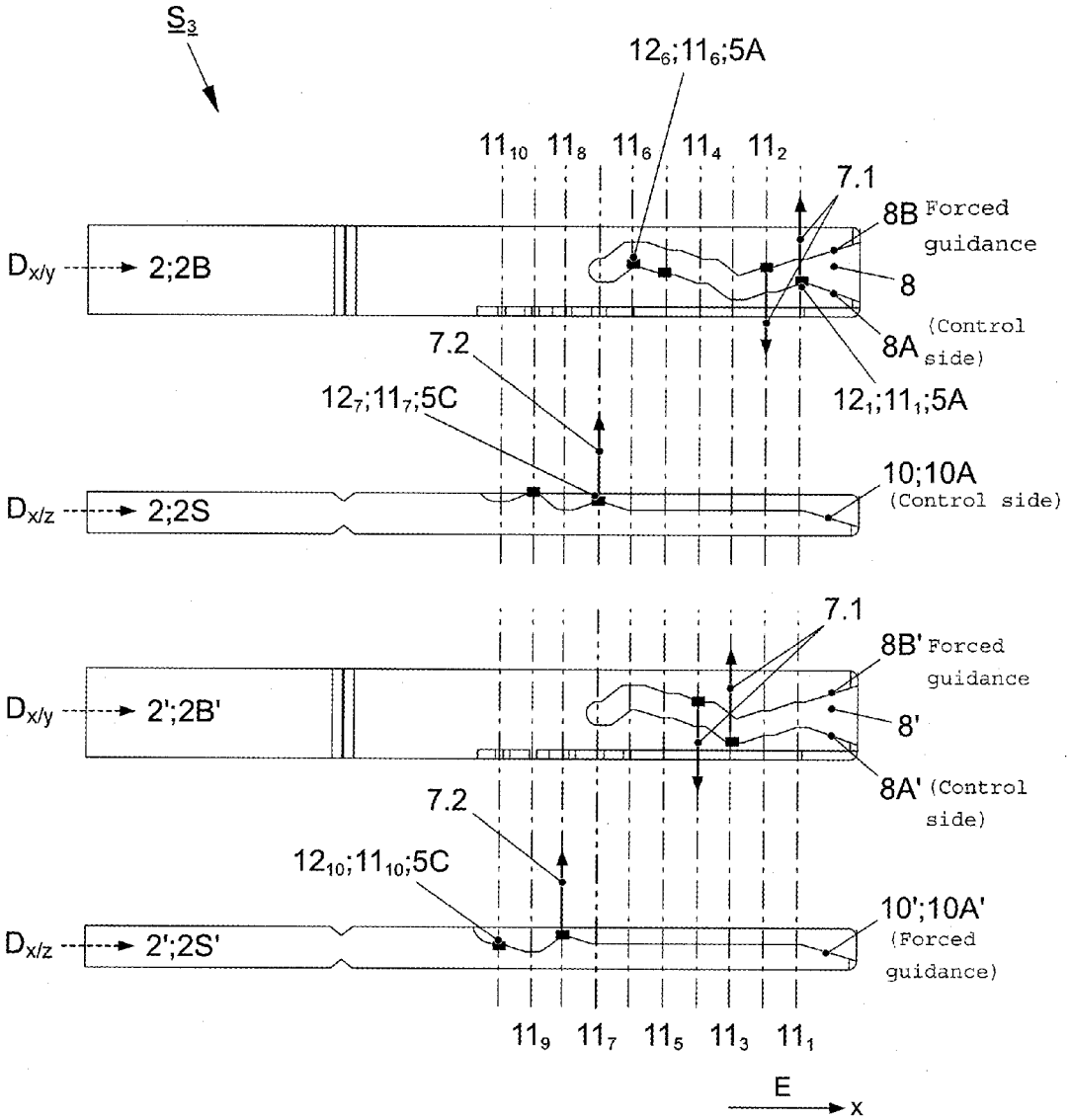

The rectangles of FIG. 8B show those scanning points $\mathbf{12}_n$ with which the cooperating scanning points of the plate tumblers 5 of the first and of the third type 5A, 5C can be scanned by the selectable radial direction of action 7.1 and 7.2 of the spring elements 3A and by an arrangement pivoted by 180° around the longitudinal axis of the plate tumblers 5A, 5C.

The arrows 7.1 and 7.2 again show the direction of action that the scanning points $\mathbf{12}_n$ of the key 2 exert opposite to the respective spring element 3A on the plate tumblers 5.

The direction of action of the spring elements 3A is further varied with respect to FIG. 8A.

The plate tumblers 5 of the first type 5A according to FIG. 8B, top image, which shows the wide outer side 2B of the key 2, are scanned, that is, pressed away by means of the first groove flank 8A in the scanning planes $\mathbf{11}_1$, $\mathbf{11}_5$, $\mathbf{11}_6$ and by means of the second groove flank 8B in the scanning plane $\mathbf{11}_2$ in both possible directions of the radial direction of movement 7.1. The plate tumblers 5 of the first type 5A engage with their tumbler noses 5A-1 on the first groove flank 8A and the second groove flank 8B of the first control track 8.

The plate tumblers 5 of the first type 5A according to FIG. 8B, third image from the top, which shows the opposite wide outer side 2B' of the key 2, are scanned, that is, pressed away by means of the first opposite groove flank 8A' in the scanning plane $\mathbf{11}_3$ and by means of the second opposite groove flank 8B' in the scanning plane $\mathbf{11}_4$ in both possible directions of the radial direction of movement 7.1. The plate tumblers 5 of the first type 5A engage with their tumbler noses 5A-1 on the first opposite groove flank 8A' and on the second opposite groove flank 8B' of the first opposite control track 8'.

The plate tumblers 5 of the third type 5C according to FIG. 8B, second image from the top, which shows the narrow outer side 2S of the key 2, are scanned, that is, pressed away by means of the control flank 10A in the scanning planes $\mathbf{11}_7$, $\mathbf{11}_9$ in a direction of the radial direction of movement 7.2. The plate tumblers 5 of the third type 5C engage with their tumbler steps 5C-1 on the first control flank 10A of the third control track 10.

The plate tumblers 5 of the third type 5C according to FIG. 8B, bottom image, which shows the opposite narrow outer side 2S of the key 2, are scanned, that is, pressed away by means of the opposite control flank 10A' in the scanning planes $\mathbf{11}_8$, $\mathbf{11}_{10}$ in a direction of the radial direction of movement 7.2 opposite to the second image from the top. The plate tumblers 5 of the third type 5C engage with their tumbler steps 5C-1 on the first opposite control flank 10A' of the third opposite control track 10'.

Thus depending on the arrangement and force direction of the plate tumblers 5 of the first or third type 5A, 5C flanks, the flanks 8A, 8B, 8A', 8B', 10, 10A' are used for scanning the cooperating scanning points of the plate tumblers 5 of the first and third type 5A, 5C.

Within the meaning of the invention in FIG. 8B in the seventh scanning plane $\mathbf{11}_7$ a scanning point $\mathbf{12}_7$ of the key 2 is again shown with a two-dot dash sequence in which it can be variably selected whether a cooperating scanning point of a plate tumbler of the first type 5A or a cooperating scanning point of the plate tumbler of the third type 5C should be queried.

In the example shown in the scanning point $\mathbf{12}_2$, $\mathbf{11}_7$ a plate tumbler 5 of the third type 5C was selected. According to the invention, it would also be possible to arrange in the scanning point $\mathbf{12}_2$, $\mathbf{11}_7$ a plate tumbler 5 of the first type 5A in the lock cylinder in the lock cylinder 3, 4 or 3, 4A, without changes having to be made to the key 2.

This procedure explained based on the third locking system $S_3$ can also be applied to all previously described locking systems $S_1$ and $S_2$ as well as $S_4$ and $S_5$.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A locking system comprising:

at least two locking devices;

a key, the at least two locking devices being actuatable with the key;

each respective locking device including a lock cylinder, the lock cylinder having a cylinder housing, a cylinder core and a key channel within the cylinder core, wherein when the key is arranged in an insertion direction, the key is insertable axially into the key channel; and at least two types of plate tumblers each having an opening, the opening of each type having a different shape, are arranged in the cylinder core of each respective locking device, such that each respective locking device has the same at least two types of plate tumblers therein, the at least two types of plate tumblers are radially displaceable with respect to a cylinder axis, such that the cylinder core is freely rotatable with respect to the cylinder housing of the lock cylinder, wherein the key has at least two control tracks via which scanning points provided on the key are scanned in at least two scanning planes lying one behind the other respectively transverse to the insertion direction, and wherein scanning points of the key, that are provided in one of the scanning planes out of the at least two scanning planes of the key, are positioned so as to be able to scan cooperating scanning points of all of the at least two types of plate tumblers in each of the at least two locking devices, respectively, such that any one of the at least two types of plate tumblers in each of the at least two locking devices may be arranged at the one scanning plane and be scanned by the scanning points provided on the key in the one scanning plane, to allow the cylinder cores of the locking devices to be adapted to a selection of one of the at least two types of plate tumblers with the same key, wherein a first control track of the at least two control tracks is provided solely on a first side of the key and a second control track of the at least two control tracks is provided solely on a second side of the key, the first side of the key being arranged perpendicular to the second side of the key.

2. The locking system according to claim 1, wherein the first control track and the second control track are configured such that the key causes the scanning of a first type of plate tumbler or of a second type of plate tumbler in the at least one scanning plane.

3. The locking system according to claim 1, wherein the first control track and the second control track are configured such that the key in all scanning planes causes the scanning of a first type of plate tumbler or of a second type of plate tumbler.

4. The locking system according to claim 2, wherein the key further includes a control track that is a mirror image of the first control track and is arranged on a side of the key that is opposite to the first side and the key includes a control track that is a mirror image of the second control track and is arranged on a side of the key that is opposite to the second side, such that a reversible key is produced.

5. The locking system according to claim 1, wherein, for displacing the plate tumblers, the key has the first control track, the second control track and a third control track that are configured such that the key in the one or in all of the at least two scanning plane/s causes the scanning of a first type of plate tumbler or of a third type of plate tumbler.

6. The locking system according to claim 5, wherein only the first control track on an opposite side of the key is arranged in a mirror image manner with respect to a first cutting plane, such that the key is a reversible key only when first plate tumblers are arranged in the respective scanning plane.

7. The locking system according to claim 1, wherein for displacing the plate tumblers, the key has the first control track, the second control track, a third control track and a fourth control track, which are configured such that the key in the one or in all of the at least two scanning plane/s causes the scanning of a third type of plate tumbler or of a fourth type of plate tumbler.

8. The locking system according to claim 1, wherein the key has at least the first control track, the second control track and a third control track, the first control track being arranged on an opposite side of the key with respect to the third control track in a non-mirror image manner, so as to provide a non-reversible key.

9. The locking system according to claim 1, wherein the key has the first control track and a third control track, the first control track being arranged on an opposite side of the key as the third control track with respect to a first and second cutting plane in a non-mirror image manner.

10. The locking system according to claim 1, wherein the first control track is a groove provided in the first side of the key and the second control track is a rib that protrudes perpendicularly from the second side of the key.

11. A locking system comprising:

four locking devices;

a key that actuates each of the four locking devices;

each respective locking device including a lock cylinder, the lock cylinder having a cylinder housing, a cylinder core and a key channel within the cylinder core, wherein when the key is arranged in an insertion direction, the key is insertable axially into the key channel; and four types of plate tumblers each having an opening, the opening of each type having a different shape, are arranged in the cylinder core of each respective locking device, such that each respective locking device has the same four types of plate tumblers therein, the four types of plate tumblers are radially displaceable with respect to a cylinder axis, such that the cylinder core is freely rotatable with respect to the cylinder housing of each lock cylinder, wherein the key has at least two control tracks via which scanning points provided on the key are scanned in at least two scanning planes lying one behind the other respectively transverse to the insertion direction, and wherein scanning points of the key, that are provided in one of the scanning planes out of the at least two scanning planes of the key, are positioned so as to be able to scan cooperating scanning points of all of the four types of plate tumblers in each of the four locking devices, respectively, such that any one of the four types of plate tumblers in each of the four locking devices may be arranged at the one scanning plane and be scanned by the scanning points provided on the key in the one scanning plane to allow the cylinder cores of the locking devices to be adapted to a selection of one of the four types of plate tumblers with the same key, wherein a first control track of the at least two control tracks is provided solely on a first side of the key and a second control track of the at least two control tracks is provided solely on a second side of the key, the first side of the key being arranged perpendicular to the second side of the key.

12. The locking system according to claim 11, wherein the first control track is a groove provided in the first side of the key and the second control track is a rib that protrudes perpendicularly from the second side of the key.

* * * * *